US010988949B2

(12) United States Patent
Puchner et al.

(10) Patent No.: US 10,988,949 B2
(45) Date of Patent: Apr. 27, 2021

(54) SAFETY SCREEN AND SAFETY SCREEN SYSTEM

(71) Applicant: DOKA GMBH, Amstetten (AT)

(72) Inventors: Andreas Puchner, Egenhofen (DE); Stefan Daubner, Fuerstenfeldbruck (DE)

(73) Assignee: DOKA GMBH, Amstetten (AT)

( * ) Notice: Subject to any disclaimer, the term of this patent is extended or adjusted under 35 U.S.C. 154(b) by 278 days.

(21) Appl. No.: 15/796,203

(22) Filed: Oct. 27, 2017

(65) Prior Publication Data

US 2019/0128000 A1 May 2, 2019

(51) Int. Cl.

| | |
|---|---|
| ***E04G 21/32*** | (2006.01) |
| *E04G 3/24* | (2006.01) |
| *E04G 1/15* | (2006.01) |

(52) U.S. Cl.

CPC ..... *E04G 21/3247* (2013.01); *E04G 21/3233* (2013.01); *E04G 3/243* (2013.01); *E04G 2001/157* (2013.01)

(58) Field of Classification Search

CPC .... E06B 11/026; E06B 11/025; E06B 11/023; E06B 3/5036; E06B 7/08; E06B 7/082; E06B 7/084; E04G 21/3204; E04G 21/3219; E04G 21/3228; E04G 21/3247; E04G 21/3233; E04G 21/3261; E04G 21/3266; E04F 10/08; E04F 10/005

USPC ..... 160/61, 92; 182/137, 138, 82

See application file for complete search history.

(56) References Cited

U.S. PATENT DOCUMENTS

| | | | | | |
|---|---|---|---|---|---|
| 591,918 | A | * | 10/1897 | Friedrich | E04F 10/0614 160/72 |
| 629,420 | A | * | 7/1899 | Brown | E06B 11/02 160/151 |
| 1,012,947 | A | * | 12/1911 | Weisfeld | A62B 1/00 182/73 |
| 1,407,062 | A | * | 2/1922 | Griffin | C04B 28/10 160/148 |
| 1,419,013 | A | * | 6/1922 | Burgess | E06B 11/02 160/151 |
| 1,470,044 | A | * | 10/1923 | Allen | E06B 7/084 160/176.1 R |
| 1,492,477 | A | * | 4/1924 | McCaskey | E06B 11/02 160/151 |
| 1,813,017 | A | * | 7/1931 | Bond | E04F 10/10 49/87.1 |

(Continued)

FOREIGN PATENT DOCUMENTS

| | | | | |
|---|---|---|---|---|
| EP | 3196383 A1 | | 7/2017 | |
| GB | 1572918 A | * | 8/1980 | E04G 21/3223 |
| GB | 2043142 A | * | 10/1980 | E04G 21/3233 |

*Primary Examiner* — Daniel P Cahn
*Assistant Examiner* — Candace L Bradford
(74) *Attorney, Agent, or Firm* — McCoy Russell LLP

(57) ABSTRACT

The present disclosure relates to a safety screen comprising: a plurality of screen members vertically arranged above one another; two longitudinal carriers pivotally connected to the screen members, wherein in a first operating position, the longitudinal carriers extend vertically and the screen members extend horizontally, and wherein in a second operating position, the longitudinal carriers are inclined sideward from vertical and the screen members extend horizontally, offset from one another horizontally.

17 Claims, 28 Drawing Sheets

(56) References Cited

U.S. PATENT DOCUMENTS 2,187,639 A * 1/1940 Bond ..... E04F 10/10 49/82.1
2,402,340 A * 6/1946 Parmenter ..... B07B 1/46 209/326
2,433,583 A * 12/1947 Thurman ..... E06B 7/084 160/60
2,592,722 A * 4/1952 Noll ..... E06B 11/021 160/328
2,994,370 A * 8/1961 Pinto ..... E06B 9/264 160/89
3,039,155 A * 6/1962 Iacovoni ..... E06B 7/082 49/65
3,305,221 A * 2/1967 Kling ..... E04F 11/181 256/21
3,455,057 A * 7/1969 Baird ..... E06B 9/28 49/64
3,839,834 A * 10/1974 Goddard ..... E04H 17/163 52/238.1
3,949,834 A * 4/1976 Nusbaum ..... E04G 21/3261 182/138
4,732,234 A * 3/1988 Brickman ..... E04G 21/3266 182/138
5,083,636 A * 1/1992 Goldenberg ..... E04G 21/3261 182/138
5,127,492 A * 7/1992 Preston ..... E04G 1/14 182/152
5,161,641 A * 11/1992 Nusbaum ..... E04G 21/3223 182/129
5,299,654 A * 4/1994 Duncan ..... E04G 21/3266 182/138
5,494,261 A * 2/1996 Gandara ..... E04H 17/166 256/24
5,820,187 A * 10/1998 Ament ..... B60R 21/06 296/24.43
8,967,224 B2 * 3/2015 Foley ..... E06B 9/262 160/84.05
9,476,210 B2 * 10/2016 Urzelai Ezkibel ..... E04G 3/20
9,500,000 B2 * 11/2016 McCarty ..... E04H 17/18
10,184,256 B2 * 1/2019 Melic ..... E04G 25/08
2005/0150613 A1 * 7/2005 Bennett, III ..... E06B 3/7001 160/229.1
2006/0225960 A1 * 10/2006 Ferlin ..... E04G 1/15 182/138
2007/0058329 A1 * 3/2007 Ledbetter ..... F16M 11/2021 361/679.06
2007/0278467 A1 * 12/2007 Ash ..... E04H 17/143 256/22
2009/0173574 A1 * 7/2009 Hobmeier ..... E04G 11/28 182/82
2010/0038518 A1 * 2/2010 Schwoerer ..... E04G 11/28 249/20
2016/0069102 A1 * 3/2016 Peck ..... E04H 17/161 256/29
2019/0145123 A1 * 5/2019 Lo ..... E04H 17/1439 256/67
2019/0264443 A1 * 8/2019 Harber ..... E04B 2/721
2020/0248469 A1 * 8/2020 Kowalski ..... E04G 21/28

* cited by examiner

SAFETY SCREEN AND SAFETY SCREEN SYSTEM

FIELD OF THE PRESENT DISCLOSURE

The present disclosure generally relates to safety screen and a safety screen system for use in the formation of a concrete structure, in particular for safeguarding workers in the construction of a high-rise building.

DESCRIPTION OF THE RELATED ART AND OBJECT OF THE PRESENT DISCLOSURE

As is known in the prior art (see for example EP 3 196 383 A1), when building a construction which has a central structure formed by poured concrete, a climbing screen system may be used to enclose the perimeter of at least a part of the construction. The climbing screen system typically includes a plurality of safety screens arranged adjacent one another to safeguard workers from adverse weather conditions and to ensure a safe working environment. As each floor of the construction is formed, the climbing screen is moved up the construction, exposing the previously formed floors beneath.

The prior art safety screens are typically designed for rectangular structures. In recent times, however, high-rise buildings with a wide range of shapes are developed.

It is an object of this present disclosure to improve on the known safety screens available in the prior art. The present disclosure particularly aims at providing a safety screen for use in the construction of buildings with complex shapes.

SUMMARY OF THE PRESENT DISCLOSURE

In a preferred embodiment, a safety screen comprises: a plurality of screen members vertically arranged above one another; two longitudinal carriers pivotally connected to the screen members, wherein in a first operating position, the longitudinal carriers extend vertically and the screen members extend horizontally, and wherein in a second operating position, the longitudinal carriers are inclined sideward from vertical and the screen members extend horizontally, offset from one another horizontally.

Thus, the longitudinal carriers are pivotable with respect to the screen members about pivot axes extending perpendicular to main planes of the screen members defining the screening surface of the safety screen. In this way, the longitudinal carriers can be pivoted sideward with respect to a floor edge in order to enclose at least a part of the perimeter of the building to be constructed. This is particularly advantageous if two floors of the building under construction are not perfectly superimposed, but are offset from one another in horizontal, lateral direction. For example, a tilt of the longitudinal carriers from vertical may be set to correspond to an angle defined by two floor edges on top of one another. When tilting the longitudinal carriers, the screen members, by means of their pivotal connections to the longitudinal carriers, are maintained in a horizontally (laterally) extending position, but are displaced laterally. Thus, in the second operating positions, the upper and lower edges of the screen members may extend horizontally while the side edges of the screen members may extend vertically, yet offset from one another in lateral direction. This results in a stepped arrangement of the side edges of the screen members. Thus, in the first and in the second operating position, the lower edge of the lowermost screen member may be arranged parallel with the floor edge of a lower floor, while the upper edge of the uppermost screen member may be arranged parallel with the floor edge of an upper floor. The construction of the safety screen disclosed herein provides for improved adjustability and adaptability, in particular when constructing or deconstructing complexly shaped buildings.

For the purpose of this disclosure, the directions and positions, such as "upwards", "downwards", "upper", "lower", "vertical", "horizontal", "sideward" etc., are given with respect to the first operating position of the safety screen arranged at the perimeter of a floor of a concrete structure under construction.

Preferably, the longitudinal axes of the longitudinal carriers are tilted by at least 20 degrees from vertical in the second operating position.

Preferably, the longitudinal carriers each have at least one engagement member for support on a safety screen support on at least one floor of the building under construction.

Preferably, the screen members have rectangular screens, in particular perforated screens, with main planes forming the screening surface of the safety screen. Preferably, the main planes of the screens are vertical in the first operating position.

In a preferred embodiment, the safety screen, in the second operating position, forms a rhomboid with a horizontally extending upper edge, a horizontally extending lower edge and opposite side edges inclined sideward from vertical. In the second operating position, the upper edge and the lower edge of the safety screen each extend horizontally over at least the major part of the lateral extension (width) of the safety screen. This embodiment is particularly favorable in view of securing the outer perimeter of a floor during construction (or deconstruction) of a building with complex geometries. In particular, gaps at adjacent sides of neighboring safety screens as well as gaps between safety screens and the edges of superimposed floors may be greatly reduced or preferably eliminated.

In a preferred embodiment, the screen members, in the first operating position, have a first vertical overlap and the screen members, in the second operating position, have a second vertical overlap, wherein the second vertical overlap is larger than the first vertical overlap. This construction facilitates the sideward tilt of the longitudinal carriers for bringing the safety screen into the second operating position without forming gaps between neighboring screen members in both of the first and second operating position. The first vertical overlap in the first operating position may be zero, whereas a non-zero second vertical overlap is formed in the second operating position. The extent of the second vertical overlap depends on the angle by which the longitudinal carriers are tilted sidewards in the second operating position.

In a preferred embodiment, the screen members each have a first screen panel and a second screen panel, the second screen panel being offset from the first screen panel in direction perpendicular to a main plane of the first screen panel. This construction enables the vertical overlap between neighboring screen members when bringing the safety screen into the laterally inclined second operating position. The first and second screen panels may be welded to one another.

Another preferred embodiment provides for: at least one lateral screen member being arranged laterally of the horizontal screen members; the lateral screen member being pivotally connected to the screen members; and in the second operating position, the lateral screen member being inclined sideward from vertical.

Preferably, two lateral screen members are arranged on either side of the lateral screen members. It is preferred that the lateral screen member(s) extend(s) over the entire vertical extension of the safety screen. In this embodiment, at least one of the (longitudinal) side edges of the safety screen is formed by the lateral screen member. In this way, lateral gaps resulting from the horizontal offset of the screen members in the second operating position are covered by the lateral screen member. Preferably, the lateral screen member(s) extend parallel to the longitudinal carriers in both of the first and second operating position.

In a preferred embodiment, first pivot axes of the screen members and second pivot axes of the lateral screen members lie in identical parallel horizontal planes in both of the first operating position and the second operating position of the safety screen. In this way, unwanted loads or variations in width resulting from the sideward tilt of the safety screen in the second operating position are minimized.

In a preferred embodiment, the lateral screen member has an inner panel and an outer panel, the outer panel being moveable laterally between a retracted state and an extended state. In the extended state of the outer panel, the safety screen has a larger lateral extension and thus a larger screening surface than in the retracted state of the outer panel.

In a preferred embodiment, a first pivot connection between one of the screen members and one of the longitudinal carriers comprises a first disk element and a housing with a plate having an opening, the first disk element being arranged in the opening of the housing. Preferably, the first disk element and the opening of the housing have corresponding shapes to allow for pivoting of the first disk element with respect to the housing. For this purpose, the first disk element preferably is circular. The diameter of the first disk element is larger, preferably by a multitude larger, than the wall thickness of the first disk element. Preferably, the first disk element is arranged vertically so that the screen member is supported on the longitudinal carrier with little leverage. Preferably, such first pivot connections are provided between each of the screen members and the two longitudinal carriers.

Preferably, a diameter of the first disk element essentially corresponds to a width, i.e. a lateral extension, of the longitudinal carrier. This construction stabilizes the longitudinal carriers in all operating positions of the safety screen.

In a preferred embodiment, the first pivot connection further comprises a second disk element larger in diameter than the first disk element, the first and second disk element being arranged on either side of the opening of the housing. Thus, the second disk element may be larger in diameter than the opening in the housing to axially secure the housing to the first disk element. Preferably, the wall thickness of the first disk element is slightly larger, for example by 0.5 to 2 mm larger, than the wall thickness of the housing neighboring the opening to allow for the rotation of the first disk element with respect to the housing.

In a preferred embodiment, a first horizontal bracing and a second horizontal bracing are provided, the first and second horizontal bracing being spaced in vertical direction from one another, the first and second horizontal bracing being pivotally connected to the longitudinal carriers. Preferably, the first and second horizontal bracing have a first end and a second end pivotally connected to the first longitudinal carrier and the second longitudinal carrier, respectively.

In a preferred embodiment, a first diagonal adjustment member for adjusting the sideward inclination of the longitudinal carriers is connected to the first and second horizontal bracing. Preferably, the first diagonal adjustment member has a first end and a second end, wherein the first end of the first diagonal adjustment member is pivotally connected to the first end of the first horizontal bracing and the second end of the first diagonal adjustment member is pivotally connected to the second end of the second horizontal bracing. This results in a diagonal arrangement of the first diagonal adjustment member between the first and second horizontal bracing.

In a preferred embodiment, a second diagonal adjustment member for adjusting the sideward inclination of the longitudinal carriers is connected to the first and second horizontal bracing. Preferably, the second diagonal adjustment member has a first end and a second end, wherein the first end of the second diagonal adjustment member is pivotally connected to the first end of the second horizontal bracing and the second end of the second diagonal adjustment member is pivotally connected to the second end of the first horizontal bracing. This results in a diagonal arrangement of the second diagonal adjustment member between the first and second horizontal bracing, transverse to the first diagonal adjustment member. This construction is particularly stable.

In a preferred embodiment, the first diagonal adjustment member comprises a first telescopic bar. A length of the first telescopic bar may be adjusted to achieve the desired sideward tilt of the safety screen. Preferably, the second diagonal adjustment member comprises a second telescopic bar.

In a preferred embodiment, in a third operating position, the longitudinal carriers are inclined backwards from vertical, and in a fourth operating position, the longitudinal carriers are inclined forward from vertical.

In this embodiment, "backward inclination" refers to a tilt of an upper edge of the safety screen away from the floor on which the safety screen is to be supported. Likewise, "forward inclination" refers to a tilt of the upper edge of the safety screen towards a center of the floor on which the safety screen is to be supported. Thus, the longitudinal carriers are pivoted about transverse pivot axes (extending laterally, i.e. parallel to the adjacent floor edge) for bringing the safety screen into the third or fourth operating position.

In a preferred embodiment, at least two anchoring bars fixable on a floor maintain the safety screen in the first or second operating position. Preferably, the anchoring bars are telescopic to allow for an adjustment of the length of the anchoring bars corresponding to the forward or backward tilt of the safety screen.

Preferably, a first pair of anchoring bars and a second pair of anchoring bars are provided, the first pair of anchoring bars being fixed closer to the edge of the floor and the second pair of anchoring bars being fixed further away from the edge of the floor.

Preferably, the at least two anchoring bars, seen in direction perpendicular to the main plane of the safety screen in the first operating position, extend in vertical planes in both of the first and second operating position, i.e. independently of the sideward tilt of the longitudinal carriers. This ensures the efficient transfer of forces into the floor by avoiding torsional moments on the anchoring bars. For this purpose, the anchoring bars preferably are fixed on the floor only after the sideward tilt of the longitudinal carriers has been adjusted.

In a preferred embodiment, a skirt member projects inwards from one of the screen members, a flap member being connected to a free end of the skirt member, the flap member being flappable upwards with respect to the skirt member. In this context, "inwards" refers to a direction towards the center of the floor on which the safety screen is supported in operation. The skirt member may be arranged for preventing objects from falling off the floor and/or for supporting a worker. In this way, objects falling off the floor edge are trapped on the skirt member. The flap member is flappable upwards from a state extending the skirt member. Preferably, the flap member is flappable only upwards, not downwards with respect to its state extending the skirt member. This construction facilitates the covering of gaps between the safety screen and the floor. Preferably, the flap member is arranged with an upward inclination in direction away from the screen members to assist the trapping of objects falling off the floor. On the other hand, the skirt member preferably is arranged in a horizontal plane which, in use, may extend along the floor edge.

Preferably, in use the flap member extends inwards from the floor edge below the floor on which the safety screen is supported. This helps catch objects falling off the floor and improves safety for the workers on the floor.

In a preferred embodiment, the longitudinal carriers are climbing rails with engaging members for engaging climbing shoes fixable adjacent an edge of a floor. The engaging members may be hooks spaced from one another in longitudinal direction of the longitudinal carriers. Preferably, the climbing rails each have two flanges (twin flanged climbing rails). In particular, the climbing rails each may have a double T profile with the two parallel flanges and a web member connecting the two flanges perpendicularly to the two flanges.

A preferred safety screen system comprises: two climbing shoes connected to mounting arms fixable adjacent an edge of a floor; and a safety screen having a plurality of screen members vertically arranged above one another, two longitudinal carriers pivotally connected to the screen members, the longitudinal carriers having engaging members supported on the climbing shoes, wherein in a first operating position, the longitudinal carriers extend vertically and the screen members extend horizontally and wherein in a second operating position, the longitudinal carriers are inclined sideward from vertical and the screen members extend horizontally, offset from one another horizontally.

In this embodiment, a climbing safety screen system is provided that is moved upward from floor to floor in the construction of a concrete structure.

In a preferred embodiment, the safety screen is supported on a single floor by means of the climbing shoes and at least two anchoring bars, preferably exactly four anchoring bars, fixed on the floor. In this embodiment, the safety screen is supported on but one floor so that the floor below or above this floor are not required for assisting the support of the safety screen.

In a preferred embodiment, the climbing shoe comprises: a support member for engaging a climbing rail of the climbing safety screen; a fork member with a first flange and a second flange; an outer member pivotally connected to the first flange and second flange about a transverse axis; and an inner member mounted to the outer member and pivotable about a longitudinal axis with respect to the outer member.

BRIEF DESCRIPTION OF THE DRAWINGS

Other objects and features of the present disclosure will become apparent from the following detailed description considered in connection with the accompanying drawings. It is to be understood, however, that the drawings are designed as an illustration only and not as a definition of the limits of the present disclosure.

FIGS. 1-66 are shown approximately to scale.

DETAILED DESCRIPTION OF THE DRAWINGS

Figure 1:
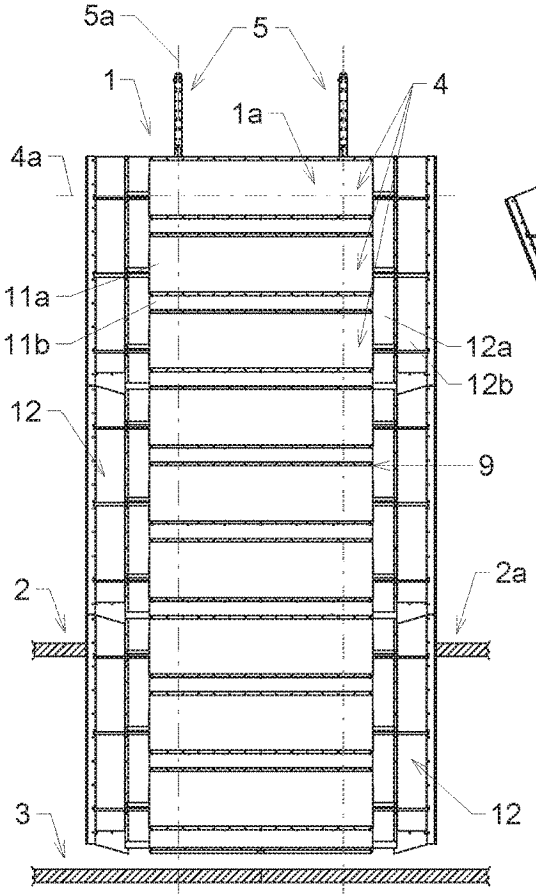
FIG. 1 is a front view of a safety screen for securing a floor of a concrete structure in a first operating position, wherein the safety screen has horizontal screen members, lateral screen members extending vertically and longitudinal carriers pivotally connected to the back sides of the horizontal screen members.

FIG. 1 shows a safety screen 1 for securing an outer perimeter of a floor 2 in the construction of a building 3. In the shown example, the safety screen 1 is a climbing safety screen (shield) 1 that is moved upwards from floor to floor. In the shown embodiment, a crane may be used to lift the safety screen 1 (and a formwork not shown in the drawings) after completion of a casting step. In an alternative embodiment, the climbing screen 1 may be self-climbing. Typically, a plurality of safety screens 1 are arranged next to each other to improve the safety of workers on the floor 2.

In the shown example, the safety screen 1 has a plurality, preferably more than three, more preferably more than six, for example nine, screen members 4 vertically arranged on top of one another in an upright position. The screen members 4 have main (principal) planes that together define a screening plane 1*a* which shields an opening formed between edges 2*a* of two superimposed floors 2. The screen members 4 may have the same lateral extension. At the inner side of the safety screen 1 (facing the building 3) two longitudinal carriers 5 connect to the screen members 4 such that the longitudinal carriers 5 can be pivoted sideward with respect to the screen members 4 in a vertical plane extending parallel to the floor edge 2*a*.

In a first operating position (shown in FIG. 1), the longitudinal axes 5*a* of the longitudinal carriers 5 extend vertically, whereas the longitudinal axes 4*a* of the screen members 4 extend horizontally in the screening surface 1*a* of the safety screen 1.

Figure 3:
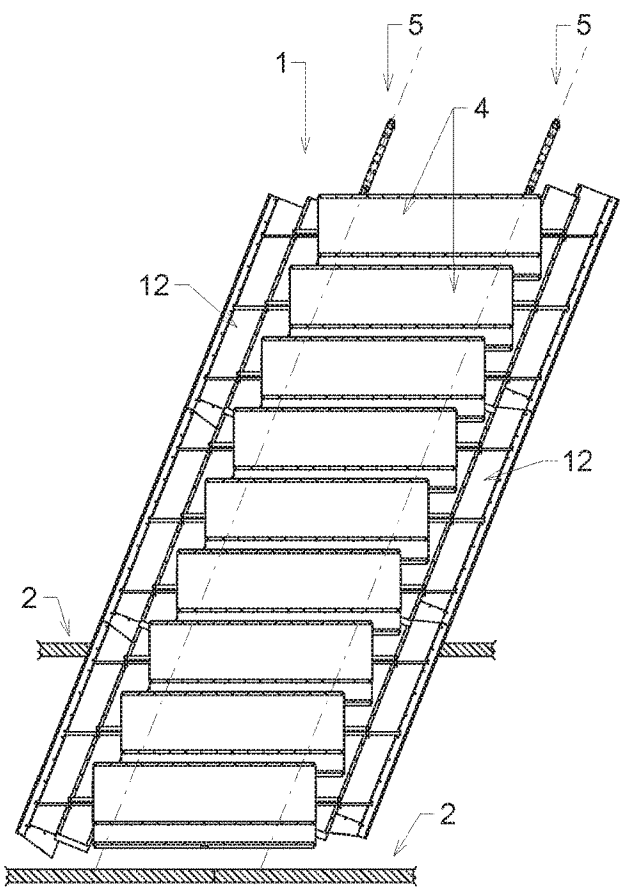
FIG. 2 and FIG. 3 are front views of the safety screen of FIG. 1 in a second operating position, in which the safety screen is tilted to the one side (FIG. 2) or to the other side (FIG. 3).
Figure 2:
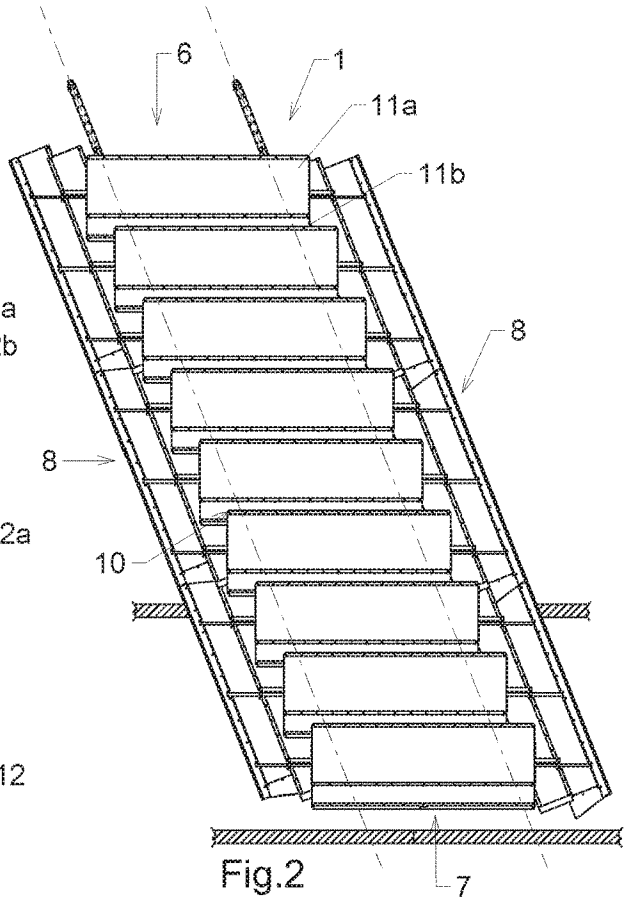

In a second operating position (shown in FIG. 2 and FIG. 3), the longitudinal carriers 5 are tilted sideward in the vertical plane extending parallel to the floor edge 2*a*. The screen members 4 are maintained in their horizontally extending position, but are arranged offset from one another horizontally in the screening plane 1*a* of the safety screen 1. For arranging the safety screen 1 in the second operating position, the longitudinal carriers 5 are pivoted about pivot axes extending perpendicularly to the screening surface 1*a* of the safety screen 1 in the one direction (see FIG. 2) or in the other direction (see FIG. 3), both with respect to the first operating position. As a result, the outer contour of the safety screen 1, in the second operating position, forms a rhomboid with a generally horizontally extending upper edge 6, a generally horizontally extending lower edge 7 and opposite side edges 8 inclined sideward from vertical (see FIG. 2). This results in a stepped arrangement of the screen members 4, in which an upper screen member 4 at one side laterally extends beyond a lower screen member 4.

In the shown example, the screen members 4, in the first operating position, have a first vertical overlap (illustrated by arrow 9 in FIG. 1) and, in the second operating position, have a second vertical overlap (illustrated by arrow 10 in FIG. 2), wherein the second vertical overlap is larger than the first vertical overlap. Thus, there is a continuous screening surface 1*a* in both of the first and second operating position. For allowing the vertical overlap of superimposed screen members 4, the screen members 4 each have a first screen panel 11*a* and a second screen panel 11*b*, wherein the second screen panel 11*b* is displaced with respect to the first screen panel 11*a* in direction perpendicular to the screening surface 1*a*.

In the shown example, the safety screen 1 further comprises two lateral screen members 12 arranged laterally of (i.e. at the sides of) the horizontal screen members 4. The lateral screen members 12 extend the screening surface 1*a* of the screen members 4 at the longitudinal sides of the safety screen 1. The lateral screen members 12 are pivotally connected to the screen members 4 such that the lateral screen members 12 in the second operating position are inclined sideward from vertical in correspondence with the longitudinal carriers 5. The longitudinal axes of the lateral screen members 12 preferably are parallel to the longitudinal axes of the longitudinal carriers 5 in both of the first and second operating position.

Figure 12:
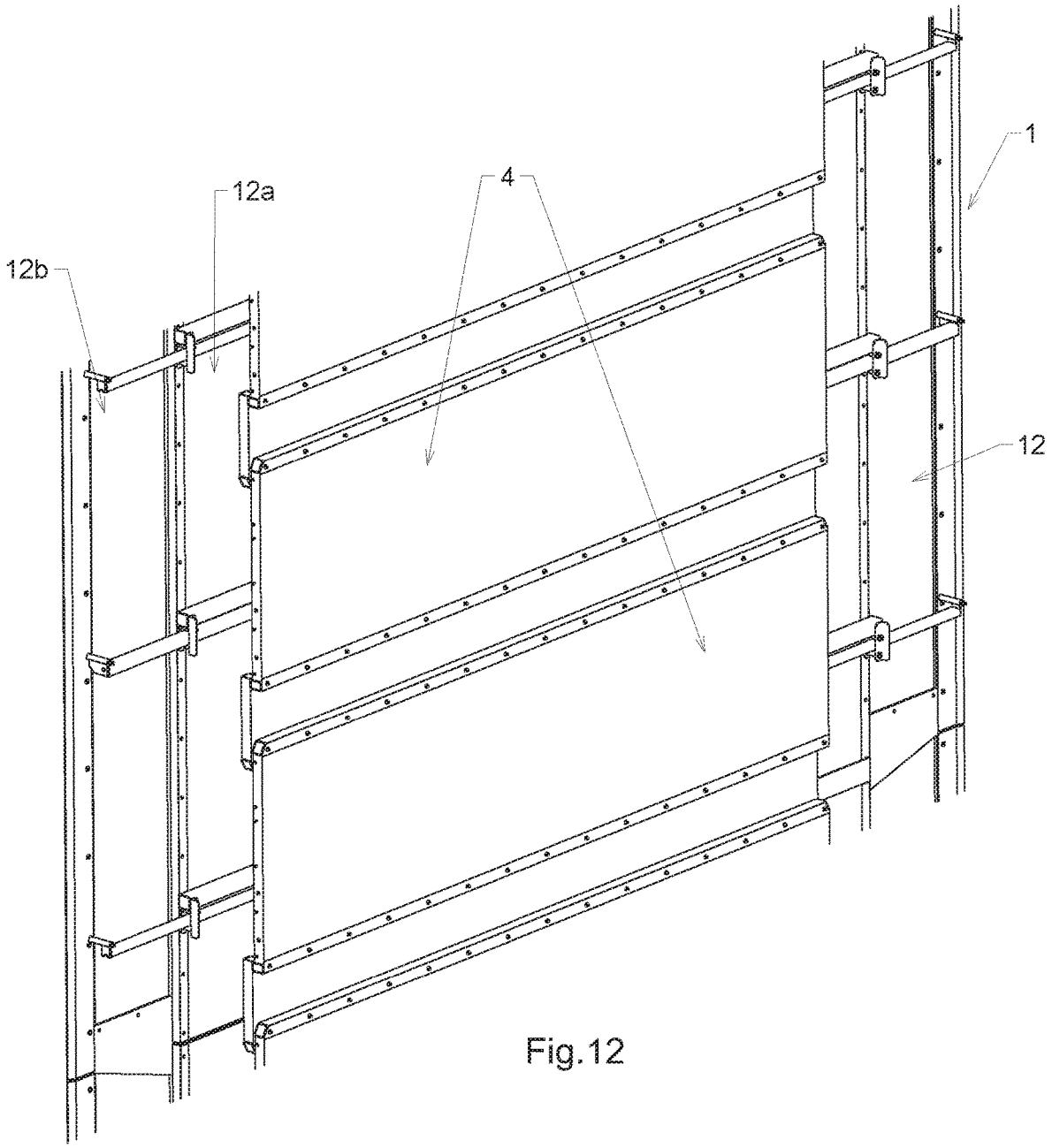
FIG. 12 is a detailed view of the safety screen of FIGS. 1 to 11 showing lateral screen members in a fully extended state.
Figure 13:
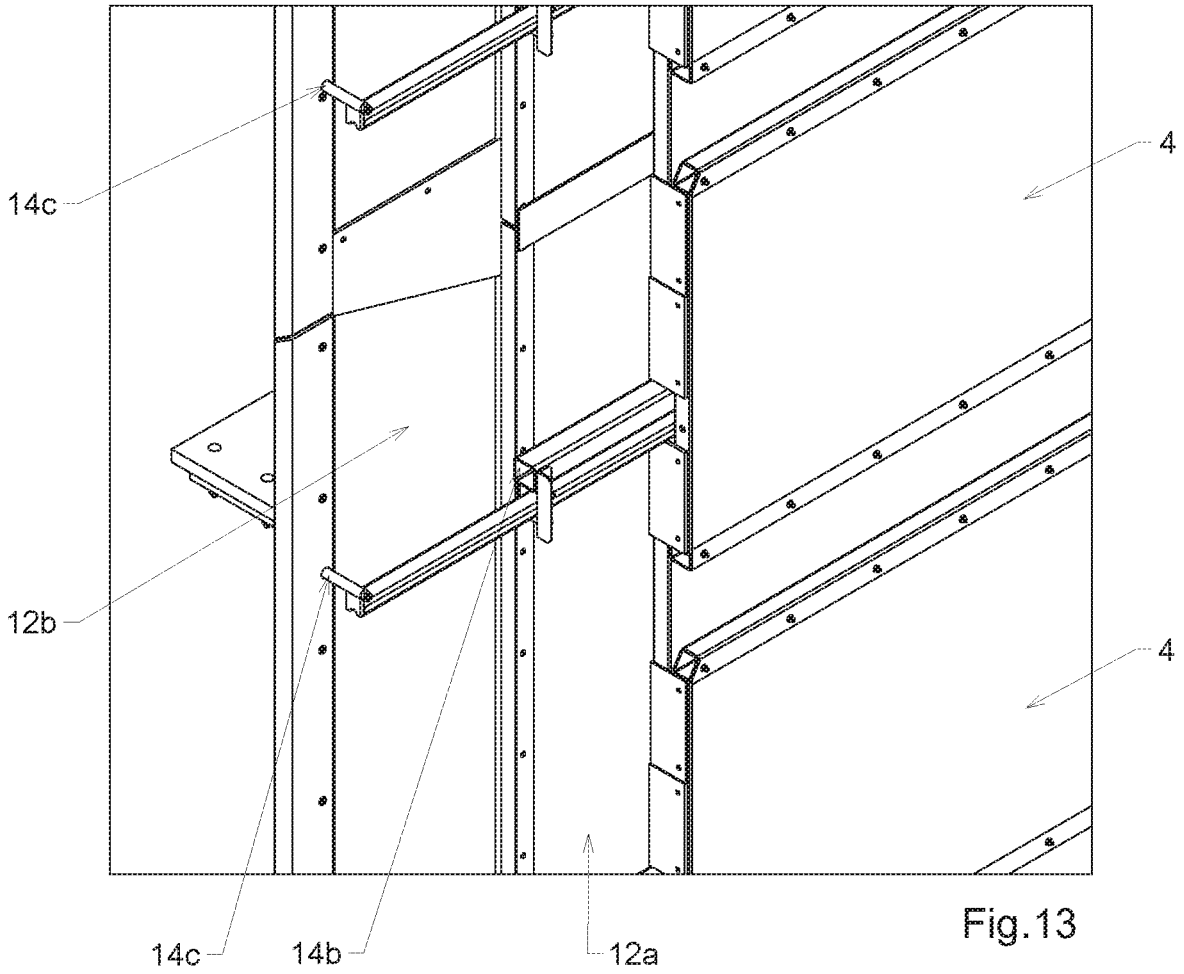
FIG. 13 is a detailed view of the safety screen of FIGS. 1 to 12 showing one of the lateral screen members in the fully extended state in greater detail.
Figure 14:
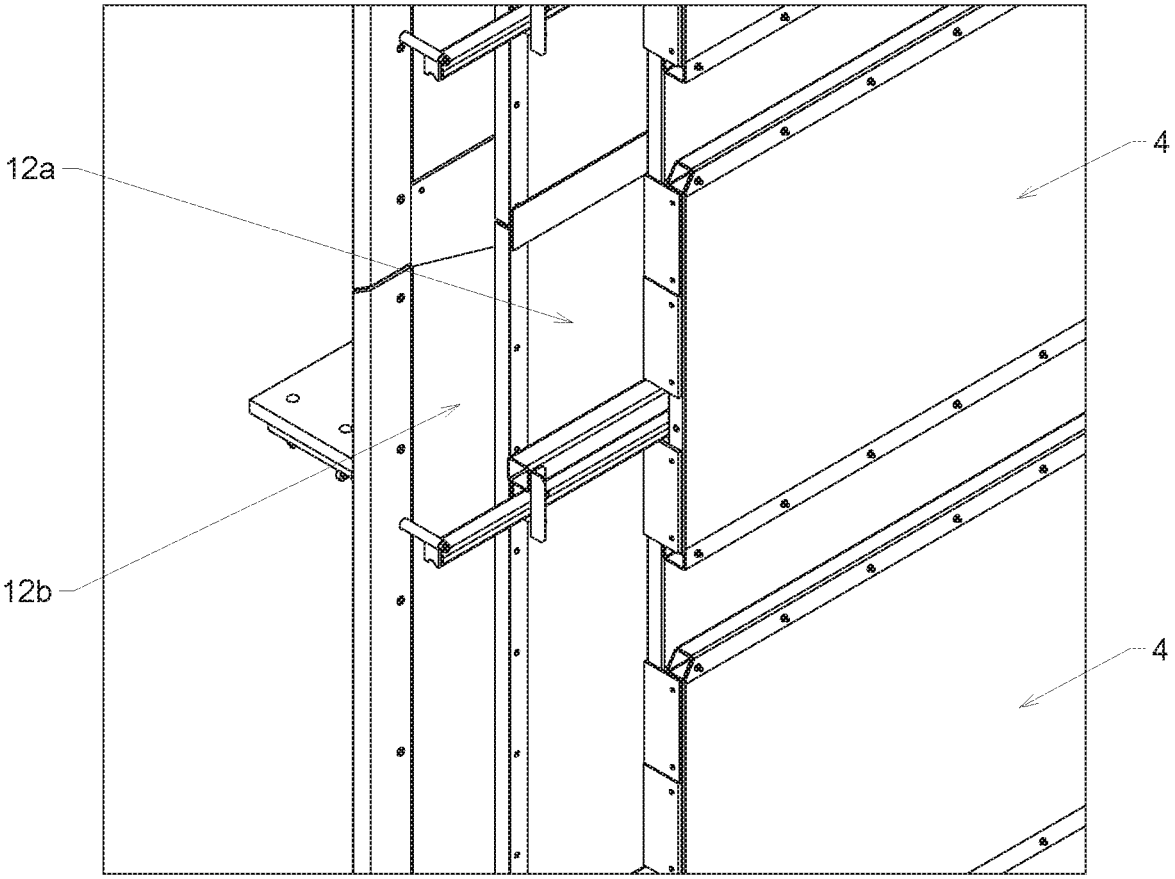
FIG. 14 is a detailed view of the safety screen of FIGS. 1 to 13 showing one of the lateral screen members in a partially retracted state.
Figure 15:
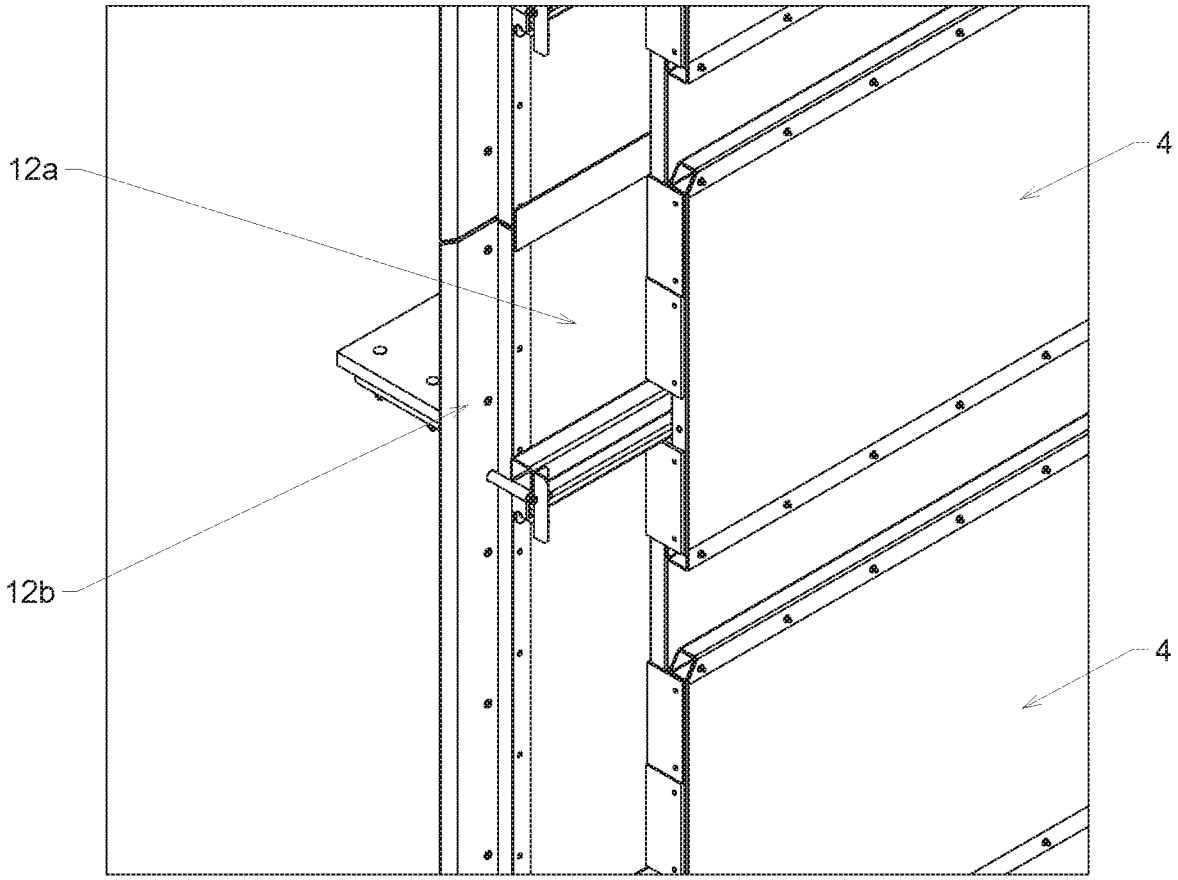
FIG. 15 is a detailed view of the safety screen of FIGS. 1 to 13 showing one of the lateral screen members in a fully retracted state.

In the shown example, the lateral screen member 12 has an inner panel 12*a* and an outer panel 12*b*, the outer panel 12*b* being moveable laterally (i.e. in horizontal direction parallel to the main plane of the safety screen 1) between an extended state (see FIG. 1, FIG. 2, FIG. 3 and in greater detail FIG. 12 and FIG. 13), a partially retracted state (see FIG. 14) and a fully retracted state (see FIG. 15). In this example, the inner panel 12*a* is immovable and the outer panel 12*b* is displaced laterally.

Figure 31:
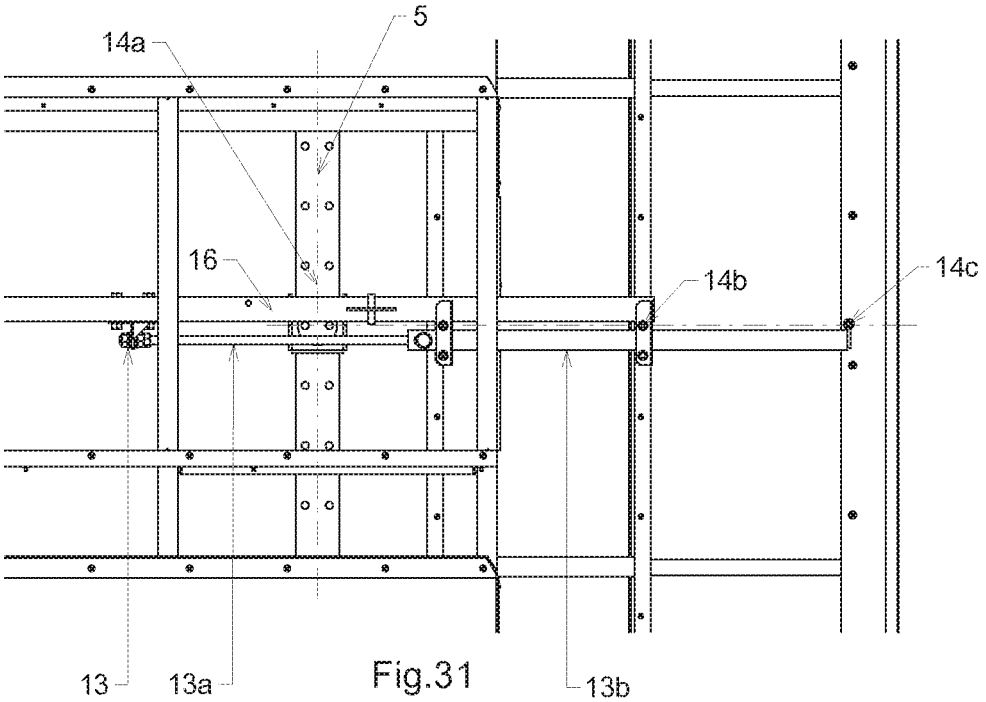
FIG. 31 and FIG. 32 are detailed views of the back side of the safety screen.
Figure 32:
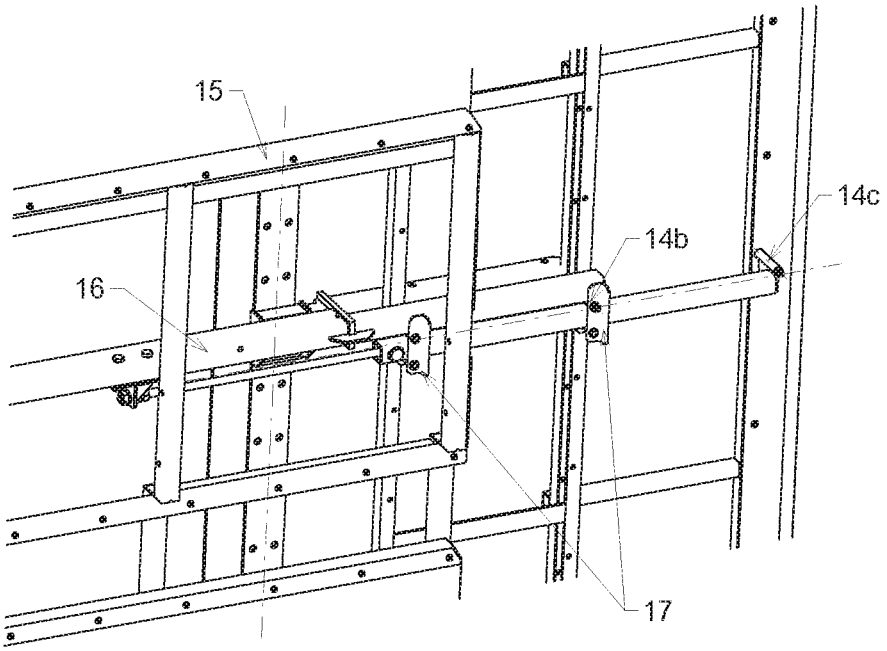

As can best be seen in FIG. 31 and FIG. 32, extension devices 13 are arranged for moving the outer panel 12*b* horizontally with respect to the inner panel 12*a*. Preferably, the extension devices 13 are telescopic. In the shown example, the extension devices 13 each have a threaded bar 13*a* engaging a threaded tube 13*b*.

As can further be seen in FIG. 31 and FIG. 32, first pivot axes 14*a* of the screen members 4, second pivot axes 14*b* of the inner panels 12*a* and third pivot axes 14*c* of the outer panels 12*b* of the lateral screen members 12 are arranged in identical horizontal lines independently of the inclination of the safety screen 1.

As can further be seen in FIG. 31 and FIG. 32, the screen members 4 each have a frame 15 for attaching the first screen panel 11*a* (not shown) and second screen panel 11*b* (not shown). At the back side of the frames 15 transverse bars 16 pivotally connect to the longitudinal carriers 5. The inner panels 12*a* of the lateral screen members 12 pivotally connect to ends of the transverse bars 16. The outer panels 12*b* of the lateral screen members 12 pivotally connect to the one ends of the extension device 13, whereas the other ends of the extension devices 13 are fixed to the transverse bars 16. In the shown example, horizontal guides 17 support the extension devices 13.

Figure 16:
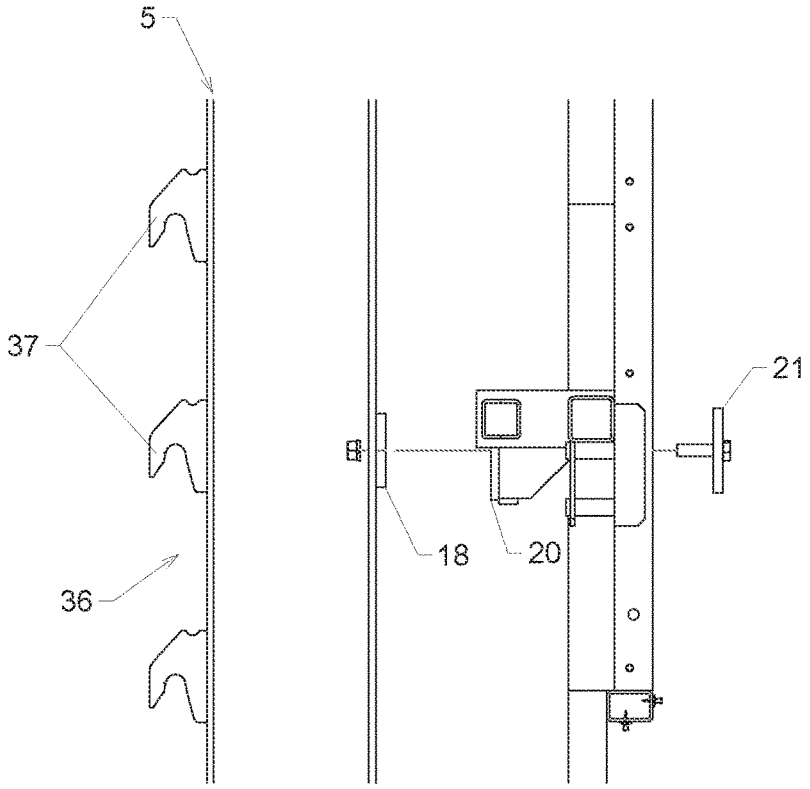
FIG. 16 and FIG. 17 are detailed views of a first pivot connection between one of the screen members and one of the longitudinal carriers of the safety screen shown in FIGS. 1 to 15.
Figure 17:
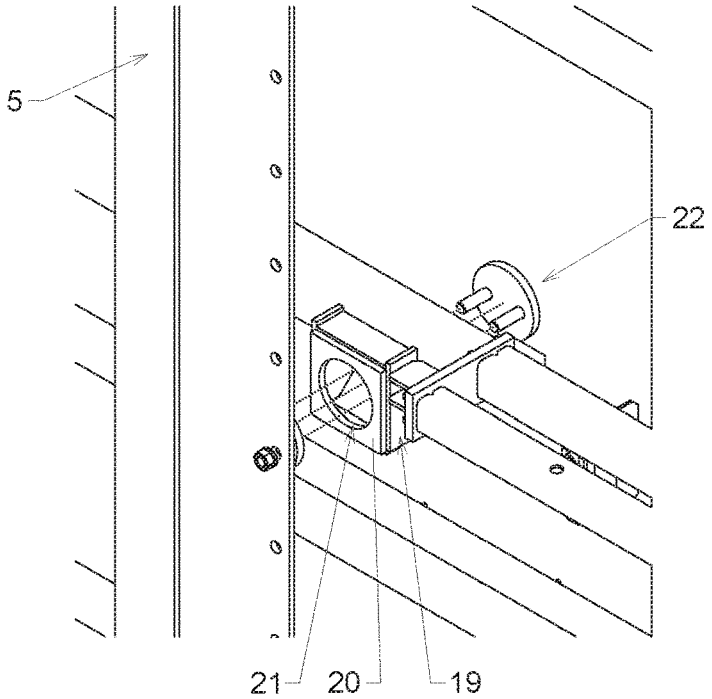

FIG. 16 and FIG. 17 show a first pivot connection between one of the screen members 4 and one of the longitudinal carriers 5. In the shown example, the first pivot connection comprises a first disk element 18 fixed to a back side of the longitudinal carrier 5 and a housing 19 with a front plate 20 having a through opening 21. The first disk element 18 accurately fits into the opening 21 of the housing 20. The first disk element 18 is circular in cross-section to be rotatably arranged in the correspondingly shaped opening 21 of the housing 20. A second disk element 22 is inserted into the housing 19 from the side facing away from the longitudinal carrier 5. The second disk element 22 has a diameter larger than the opening 21 so that the housing 20 is secured to the longitudinal carrier 5 in direction of the first pivot axis 14*a*.

Figure 5:
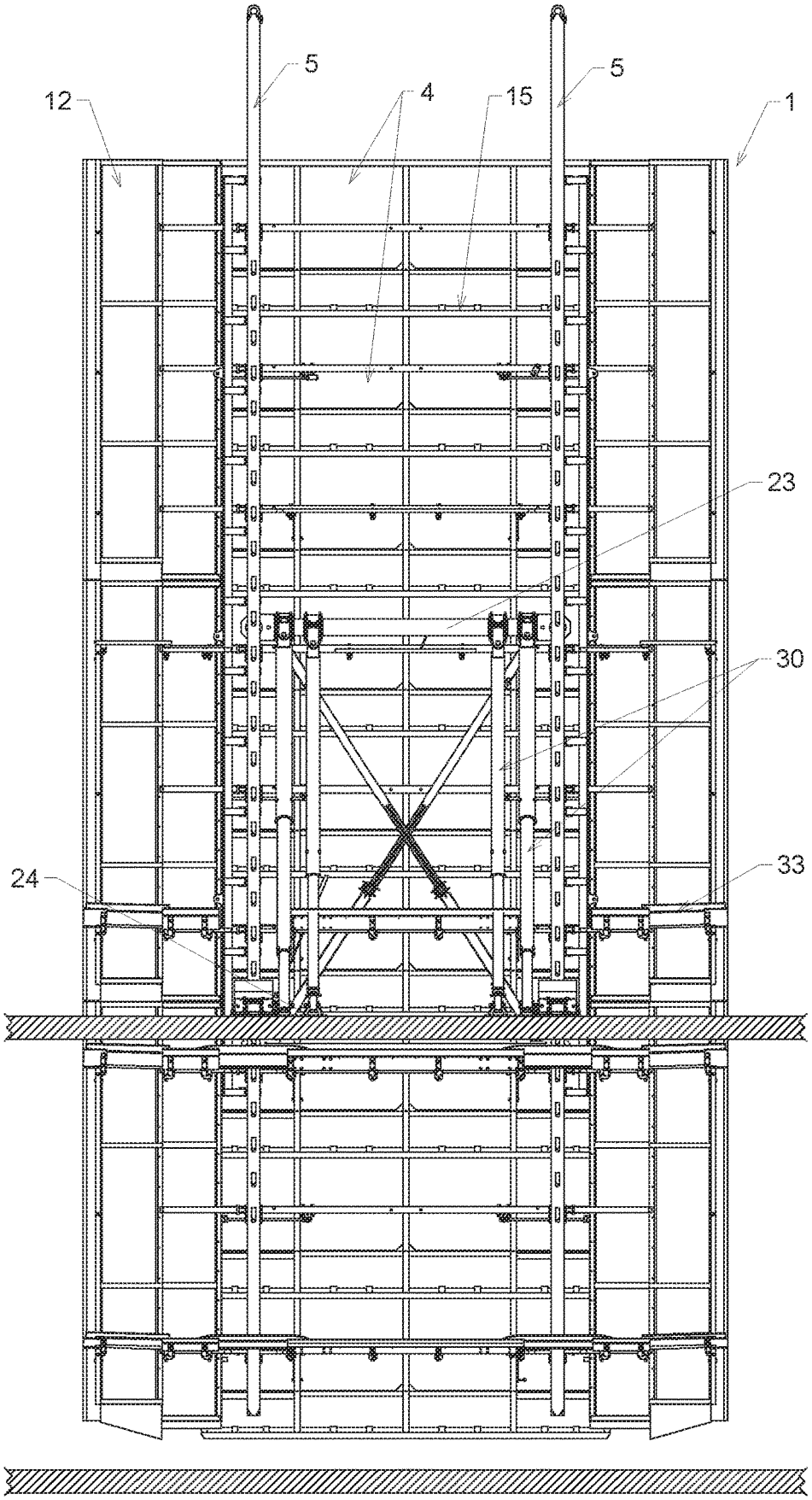
FIG. 5 is a front view of the safety screen of FIGS. 1 to 4 seen from inside the concrete structure.

As can best be seen in FIG. 5 (and in greater detail in FIG. 24 to 27), the safety screen 1 further comprises a first (upper) horizontal bracing 23 and a second (lower) horizontal bracing 24 spaced vertically from one another. Each of the first horizontal bracing 23 and second horizontal bracing 24 is pivotally connected to the longitudinal carriers 5 so that the first horizontal bracing 23 and the second horizontal bracing 24 extend horizontally (laterally) independently of the sideward inclination of the longitudinal carriers 5. In the shown example, the first horizontal bracing 23 is elongate with a first end 23*a* and a second end 23*b* pivotally connected to a first longitudinal carrier of the longitudinal carriers 5 and a second longitudinal carrier of the longitudinal carriers 5, respectively. Likewise, the second horizontal bracing 24 is elongate with a first end 24*a* and a second end 24*b* pivotally connected to the first longitudinal carrier and the second longitudinal carrier, respectively.

Figure 20:
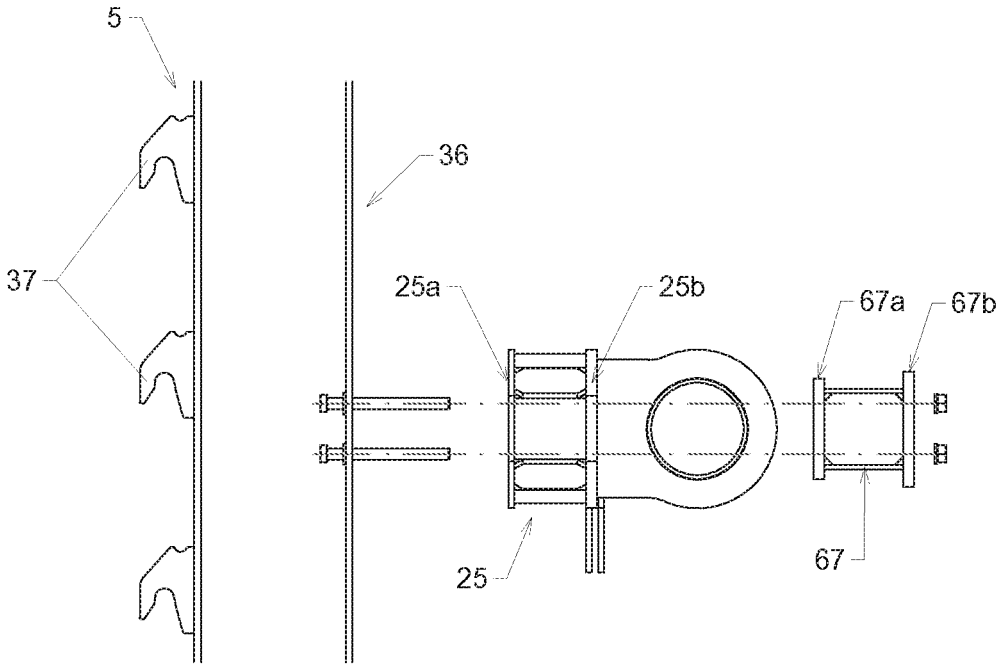
FIG. 20 and FIG. 21 are detailed views of a second pivot connection between a first horizontal bracing and one of the longitudinal carriers of the safety screen shown in FIGS. 1 to 19.
Figure 21:
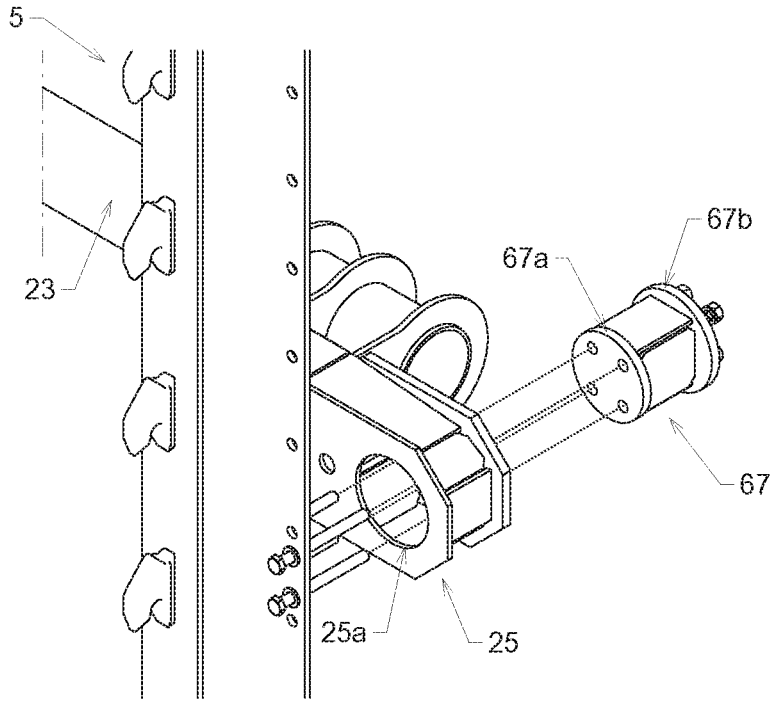

FIG. 20 and FIG. 21 show an example of a second pivot connection between the first horizontal bracing 23 and one of the longitudinal carriers 5. In the shown example, the second pivot connection comprises a first insert 67 fixed to a back side of the longitudinal carrier 5 and a body member 25 for accommodating the first insert 67. The first insert 67 has a first circular support surface 67*a* and a second circular support surface 67*b*. The second circular support surface 67*b* is larger in diameter than the first circular support surface 67*a*. The body member 25 has a first circular opening 25*a* for a rotatable support of the first circular support surface 67*a* and a second circular opening 25*b* which is covered by the larger diameter of the second circular support surface 67*b* thus securing the body member 25 to the longitudinal carrier 5 in direction of the second pivot axis.

Figure 22:
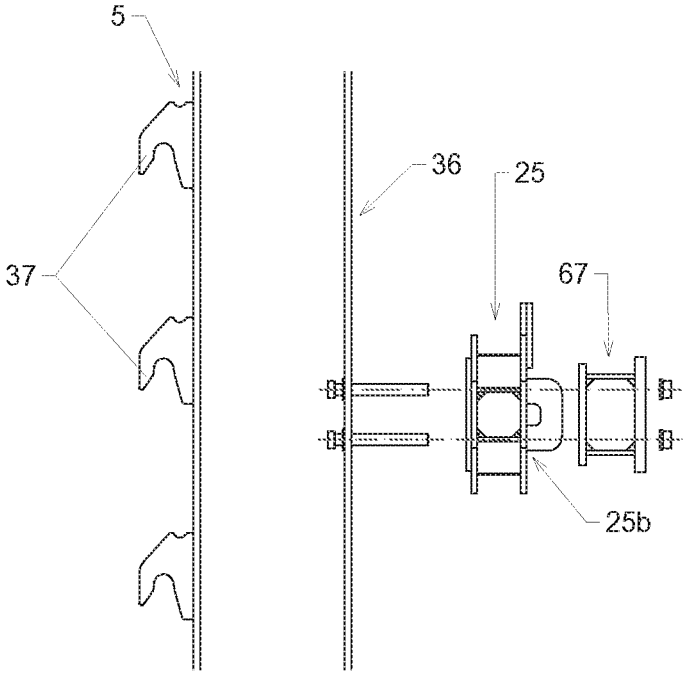
FIG. 22 and FIG. 23 are detailed views of a third pivot connection between a second horizontal bracing and one of the longitudinal carriers of the safety screen shown in FIGS. 1 to 21.
Figure 23:
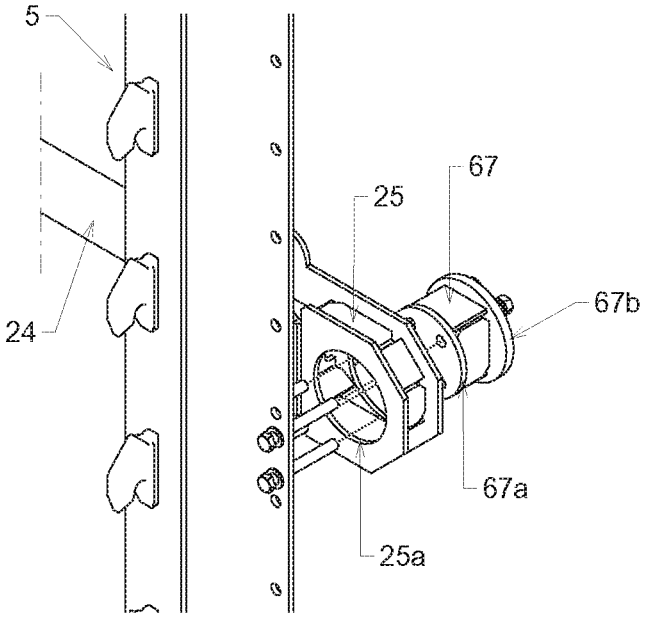
Figure 24:
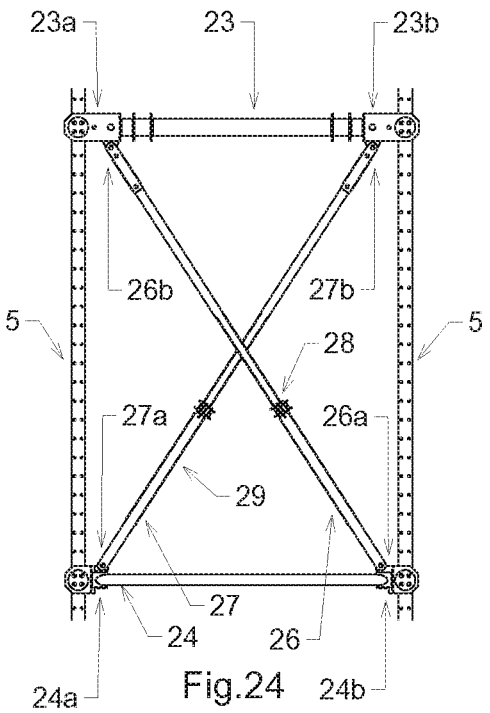
FIG. 24 and FIG. 25 are detailed views of the first and second horizontal bracing and a first and second diagonal adjustment member in the first operating position of the safety screen.
Figure 25:
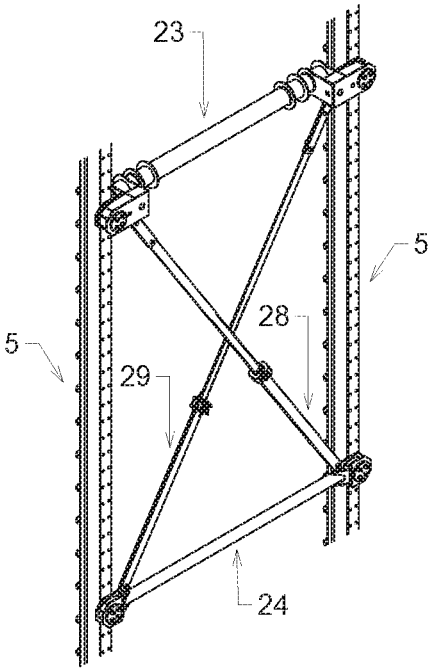
Figure 26:
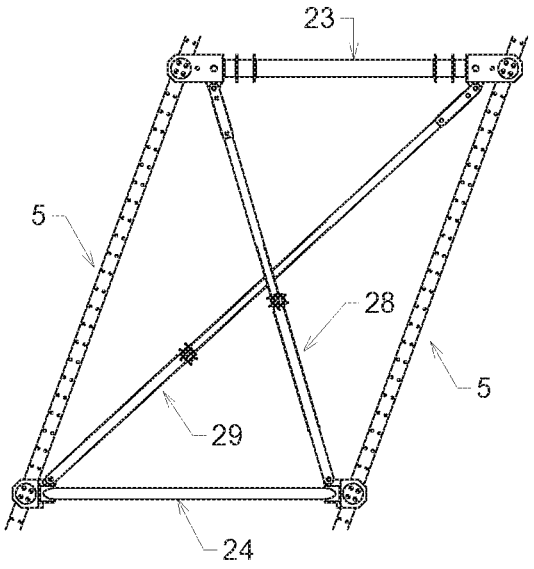
FIG. 26 and FIG. 27 are detailed views of the first and second horizontal bracing and the first and second diagonal adjustment member in the second operating position of the safety screen.
Figure 27:
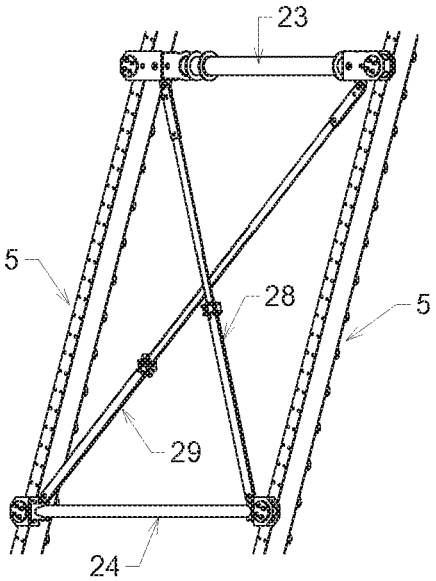

FIG. 22 and FIG. 23 illustrate an example of a third pivot connection between the second horizontal bracing 24 and one of the longitudinal carriers 5. The functioning of the third pivot connection is equivalent to the second pivot connection (see above).

FIGS. 24, 25, 26 and 27 illustrate an exemplary embodiment for adjusting the sideward tilt of the safety screen 1.

In this embodiment, a first diagonal adjustment member 26 and a second diagonal adjustment member 27 are arranged for adjusting the sideward inclination of the longitudinal carriers 5. The first diagonal adjustment member 26 has a first end 26*a* and a second end 26*b*, wherein the first end 26*a* of the first diagonal adjustment member 26 is pivotally connected to the first end 23*a* of the first horizontal bracing 23 and the second end 26*b* of the first diagonal adjustment member 26 is pivotally connected to the second end 24*b* of the second horizontal bracing 24. The second diagonal adjustment member 27 has a first end 27*a* and a second end 27*b*, wherein the first end 27*a* of the second diagonal adjustment member 27 is pivotally connected to the first end 24*a* of the second horizontal bracing 24 and the second end 27*b* of the second diagonal adjustment member 27 is pivotally connected to the second end 23*b* of the first horizontal bracing 23. In this way, the sections of the longitudinal carriers 5 between the second and third pivot connections, the first horizontal bracing 23 and the second horizontal bracing 24 form a rectangle in the first operating position and a rhomboid in the second operating position.

Figure 28:
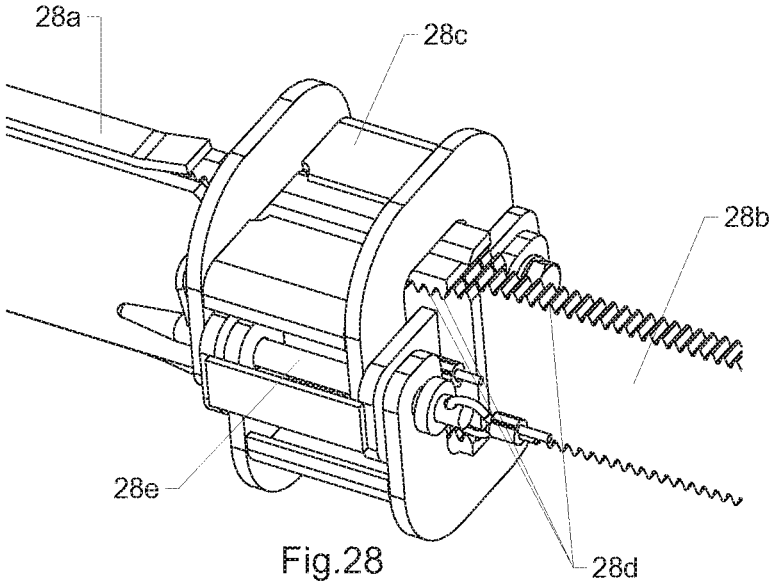
FIG. 28 is a detailed view of the first and second diagonal adjustment member of FIG. 24 to FIG. 27 in a locked state for maintaining a given sideward tilt of the longitudinal carriers.
Figure 29:
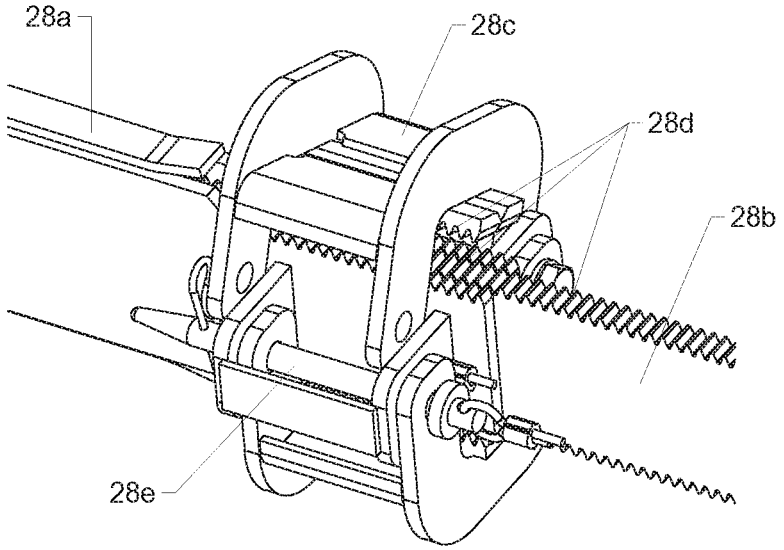
FIG. 29 is a detailed view of the first and second diagonal adjustment member of FIG. 24 to FIG. 27 in a released state for adjusting the sideward tilt of the longitudinal carriers.
Figure 30:
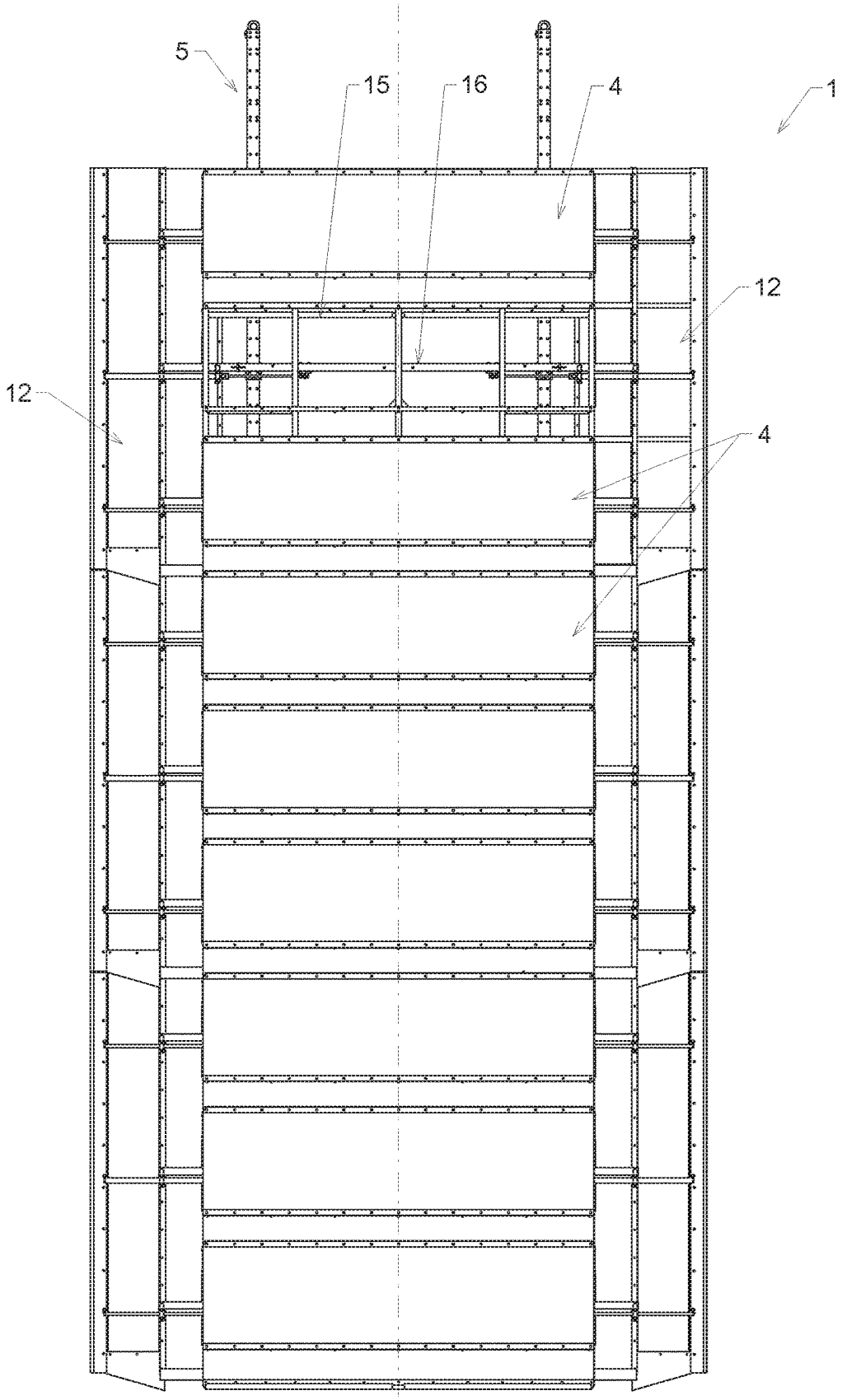
FIG. 30 is a front view of the safety screen, wherein a first and second screen panel of one of the screen members has been removed so that a frame supporting this screen member can be seen.

As can best be seen in FIG. 28 and FIG. 29, the first diagonal adjustment member 26 may comprise a first telescopic bar 28 adjustable in length. In the shown example, the first telescopic bar 28 has a first longitudinal part 28*a*, a second longitudinal part 28*b* and a locking member 28*c* for locking the first longitudinal part 28*a* and the second longitudinal part 28*b* at a given length of the first telescopic bar 28. For this purpose, the first longitudinal part 28*a*, second longitudinal part 28*b* and locking member 28*c* may have correspondingly shaped locking teeth 28*d* that engage one another in a locking position shown in FIG. 28. The locking member 28*c* can be released (see FIG. 29) to disengage the locking teeth 28*d* from one another and allow for adjustment of the length of the telescopic bar 28. In the shown example, a removable locking pin 28*e* is provided for securing the locking member 28*c* in the locking position. The second diagonal adjustment member 27 may comprise a second telescopic bar 29 adjustable in length. The construction of the second diagonal adjustment member 27 may be identical to the first diagonal adjustment member 26 so that explanations thereof are omitted herein.

In the shown example, the safety screen 1 may be tilted backwards with respect to the vertical first operating position so that the upper edge 6 of the safety screen 1 is displaced outwardly, away from the edge 2*a* of the floor 2. Furthermore, the safety screen 1 may be tilted forwards with respect to the vertical first operating position so that the upper edge 6 of the safety screen 1 projects inwardly from the edge 2*a* into the space above the floor 2. Thus, in a third operating position, the longitudinal carriers 5 are inclined backwards from their vertical arrangement in the first operating position. In a fourth operating position, the longitudinal carriers are inclined forward from vertical. The backward or forward tilt of the safety screen 1 may be combined with the sideward tilt of the safety screen 1 described above.

Figure 7:
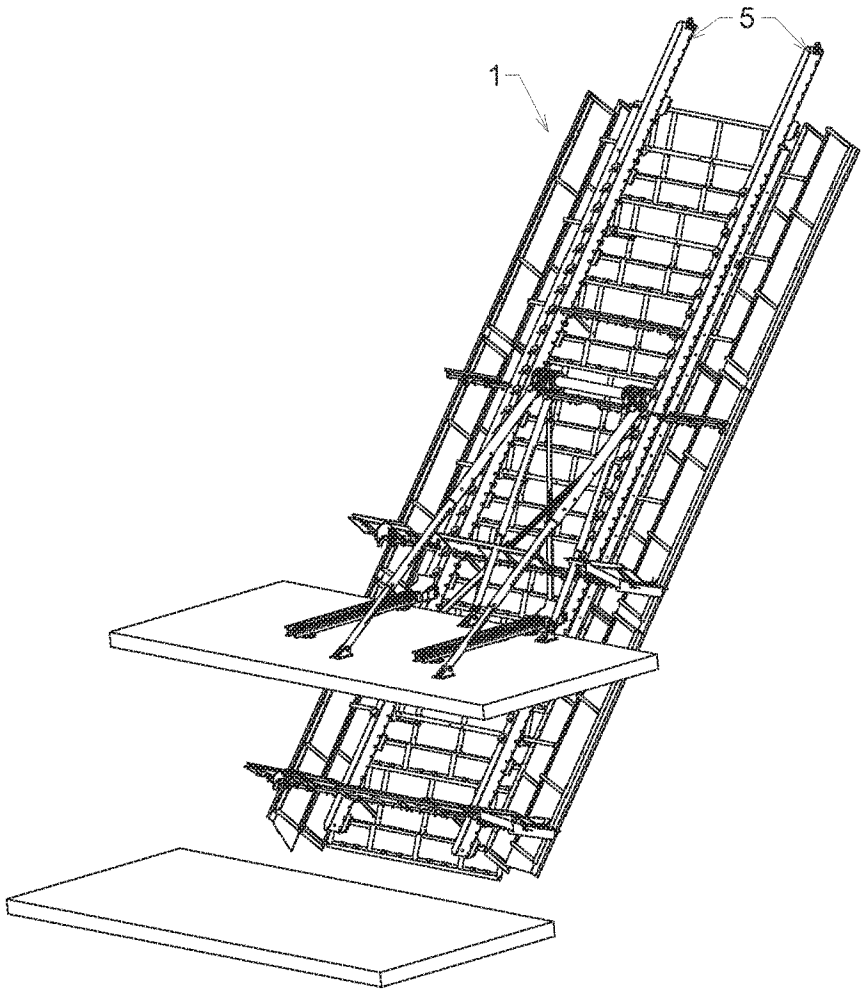
FIG. 6 and FIG. 7 are perspective views of the safety screen of FIGS. 1 to 5 in a fifth operating position, wherein the safety screen is tilted backward and sideward in opposite directions, respectively.
Figure 6:
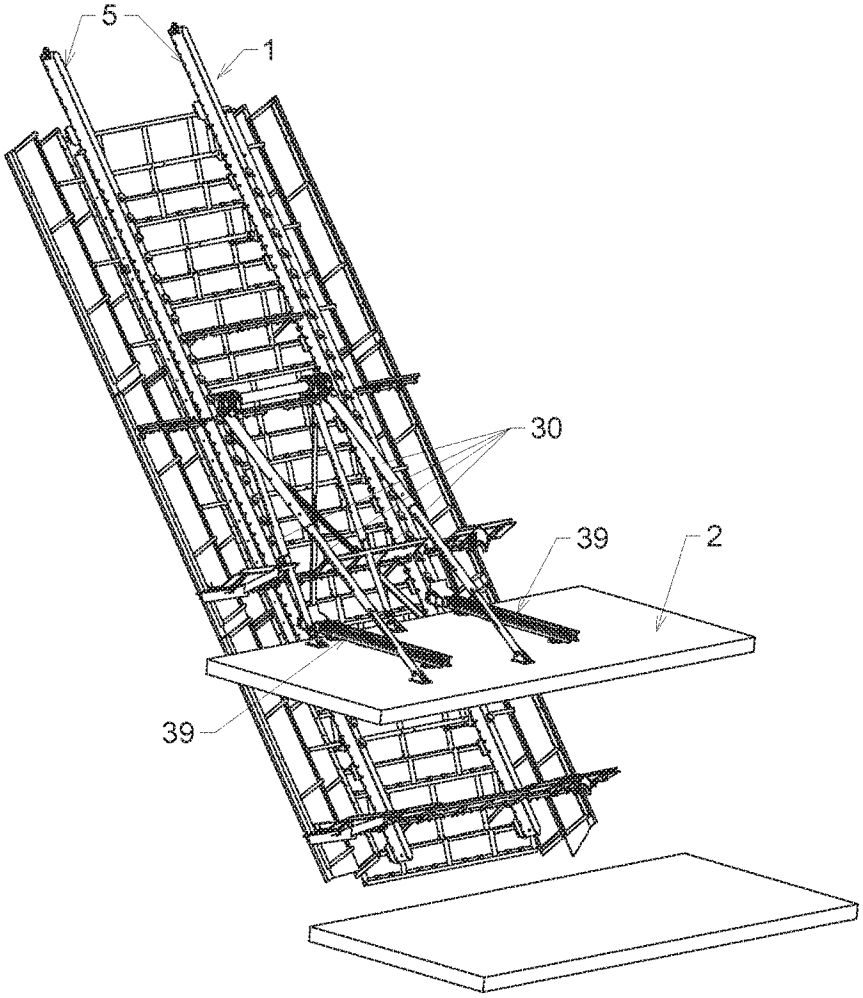
Figure 9:
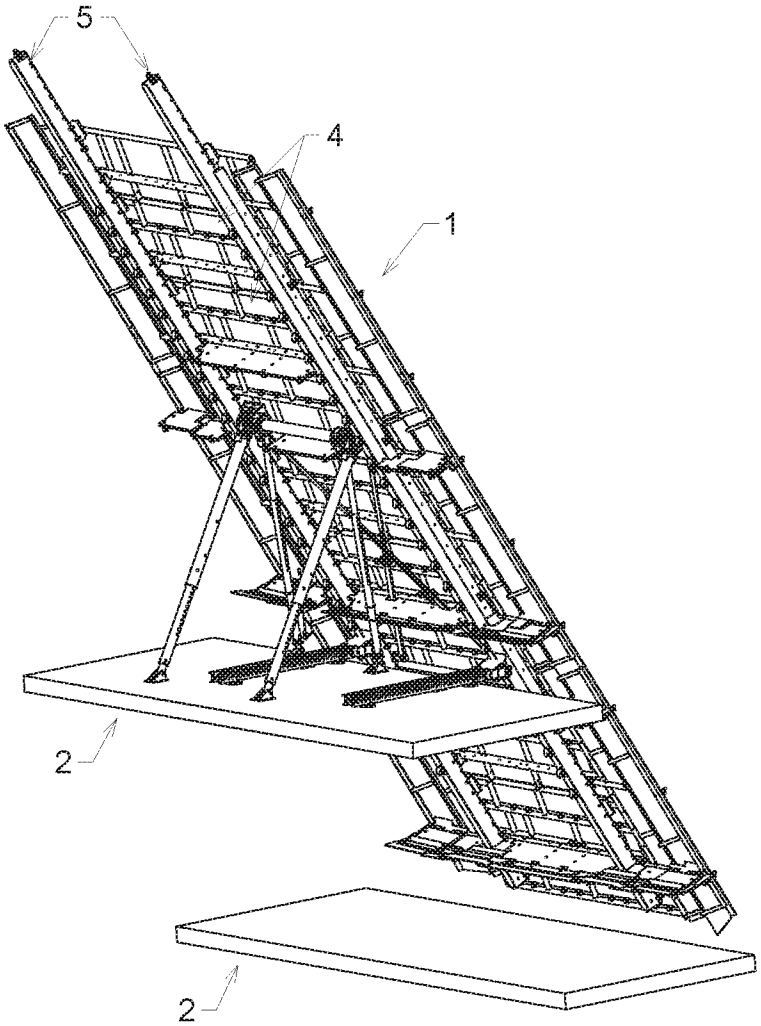
FIG. 8 and FIG. 9 are perspective views of the safety screen of FIGS. 1 to 7 in a sixth operating position, wherein the safety screen is tilted forward and sideward in opposite directions, respectively.
Figure 8:
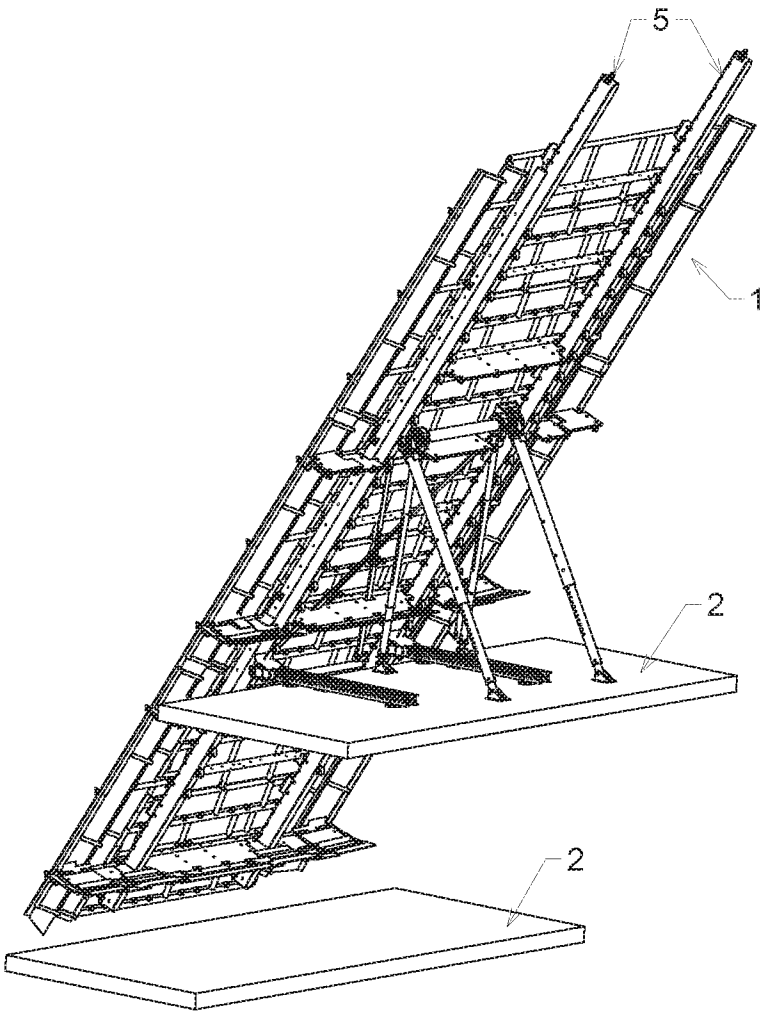

FIG. 6 and FIG. 7 show the safety screen 1 in a fifth operating position (backward tilt and sideward tilt in the first and second direction, respectively). FIG. 8 and FIG. 9 show the safety screen (shield) 1 in a sixth operating position (forward tilt and sideward tilt in the first and second direction, respectively).

Figure 10:
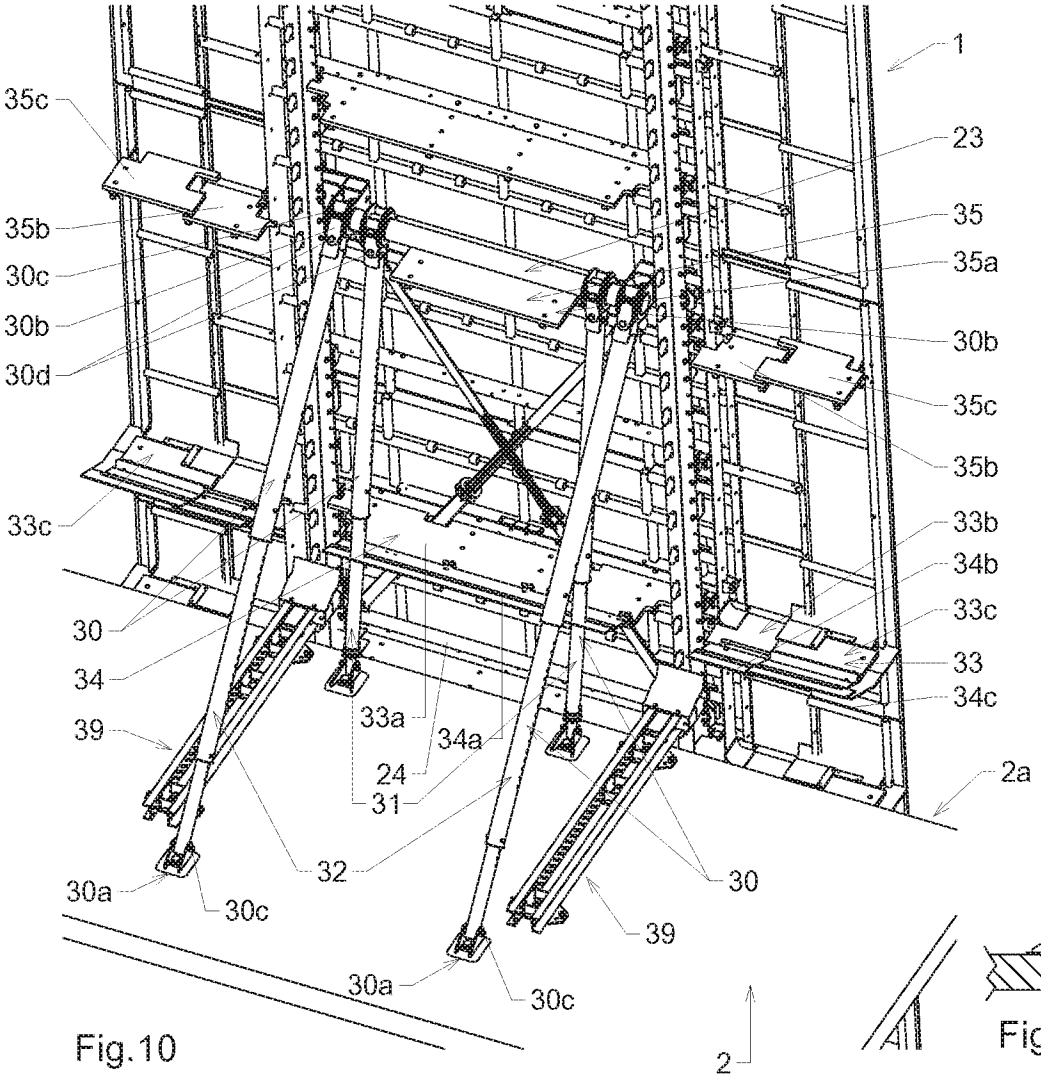
FIG. 10 is a detailed perspective view of the safety screen of FIGS. 1 to 9 in the first operating position.
Figure 11:
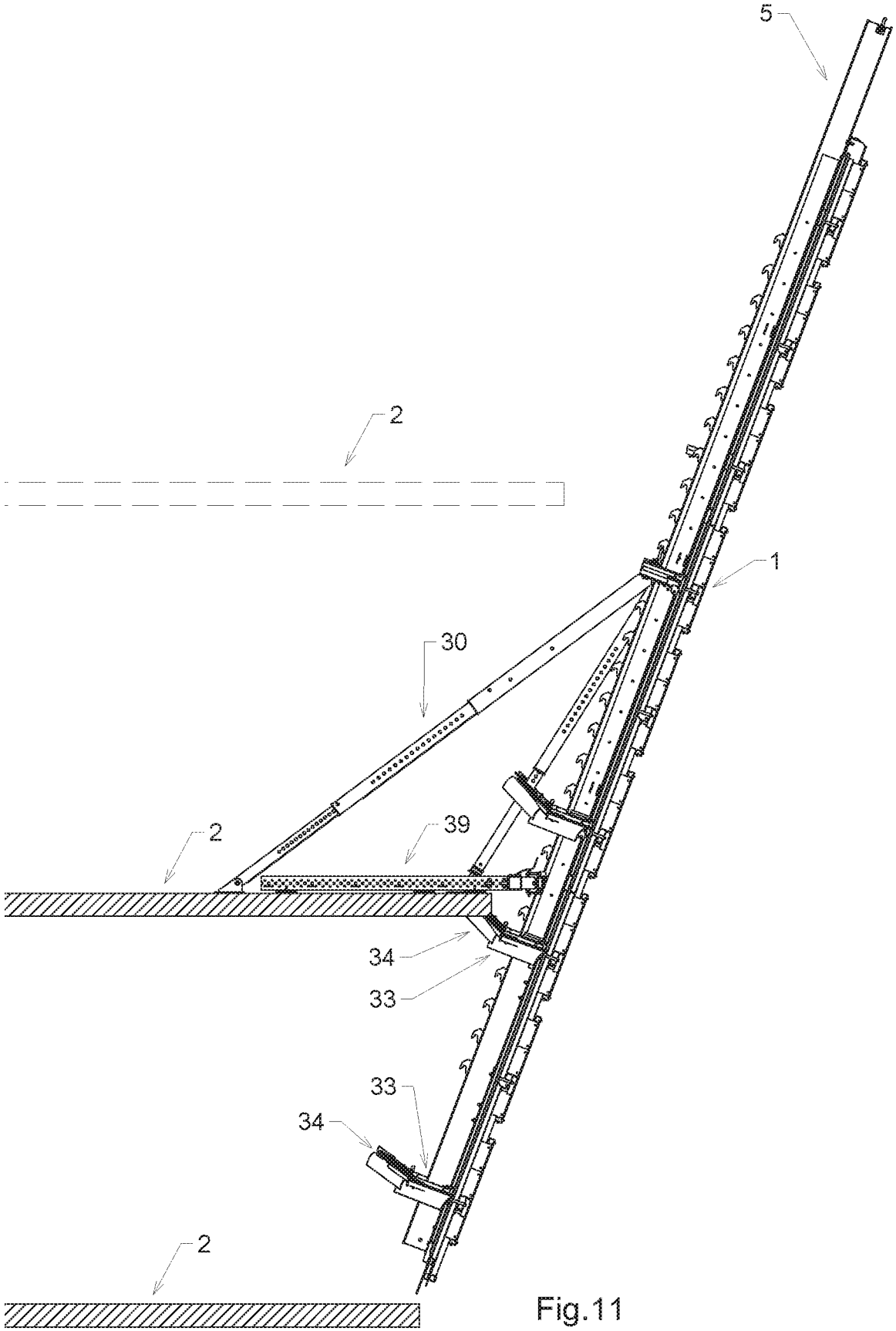
FIG. 11 is a side view of the safety screen of FIGS. 1 to 10 in a position tilted backward.

In the shown embodiment, at least two anchoring bars 30 are fixed on the floor 2 for maintaining the safety screen 2 in one of the first, second, third, fourth, fifth or sixth operating position (see, for example, FIG. 10 and FIG. 11). The one ends 30*a* of the anchoring bars 30 are attached to the floor 2, whereas the other ends 30*b* of the anchoring bars 30 are connected to the first horizontal bracing 23. To allow for the forward and backward tilting of the safety screen 1, the one ends 30*a* and the other ends 30*b* are pivotable about laterally extending pivot axes 30*c* against the floor 2 and the first horizontal bracing 23, respectively.

Figure 18:
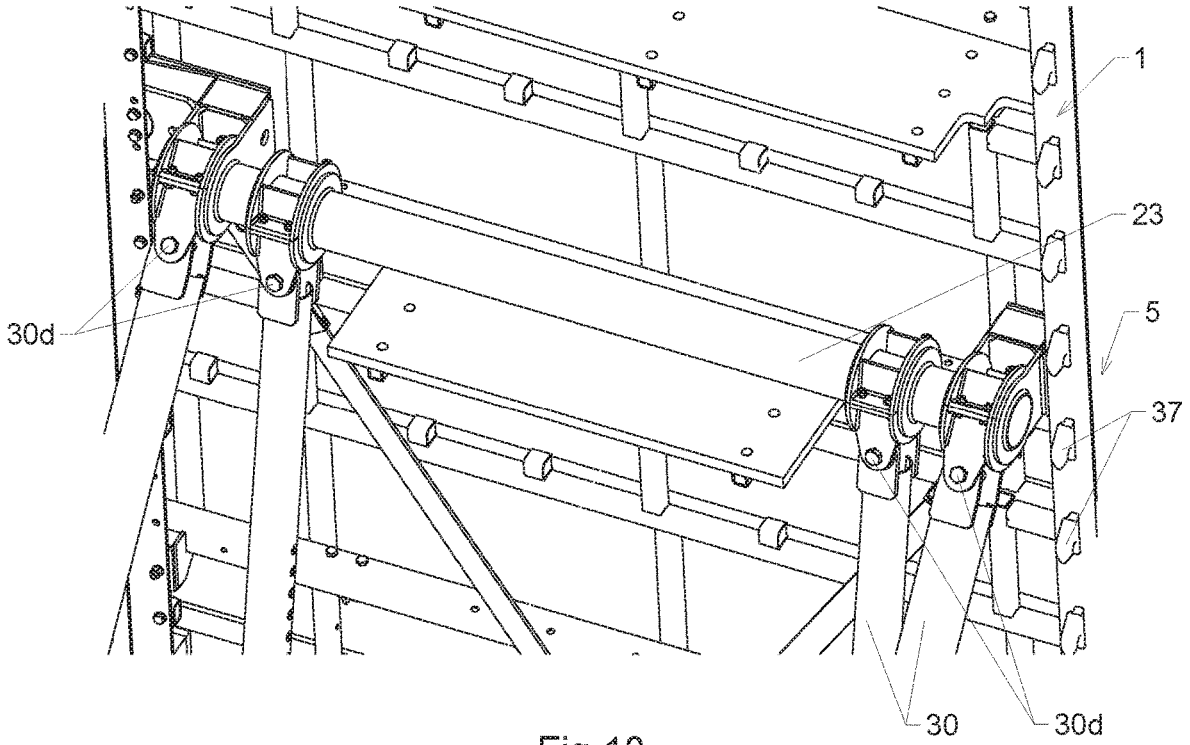
FIG. 18 and FIG. 19 are detailed views of the safety screen of FIGS. 1 to 17 showing the attachment of anchoring bars for maintaining the safety screen in a given backward or forward tilt.
Figure 19:
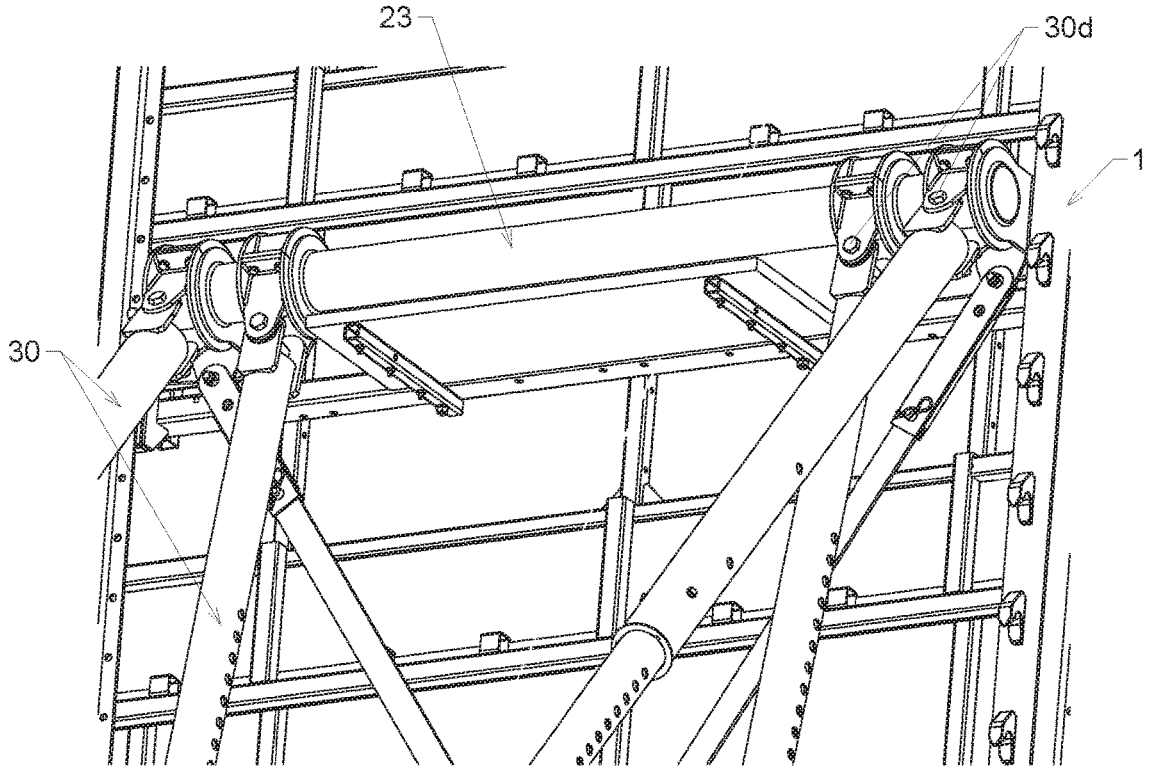

In the shown example, the other ends 30*b* of the anchoring bars 30 are pivotable about axes 30*d* perpendicular to the screening surface 1*a* (see FIG. 18 and FIG. 19 for greater detail) to allow for stowing of the anchoring bars 30 when moving the safety screen 1 upwards to the next floor 2.

In the shown example, the anchoring bars 30 are telescopic to allow for an adjustment of the length of the anchoring bars 30. Preferably, a first pair 31 of telescopic anchoring bars 30 and a second pair 32 of telescopic anchoring bars support the safety screen 1 on the floor 2. The first pair 31 of anchoring bars 30 is fixed to the floor 2 closer to the edge 2*a* than the second pair 32 of anchoring bars 30. In the shown example, the anchoring bars 30 are fixed on the floor 2 after the sideward tilt of the safety screen 1 was adjusted so that the loads from the safety screen 1 are effectively transferred into the floor 2 independently of the sideward tilt of the safety screen 1.

Figure 4:
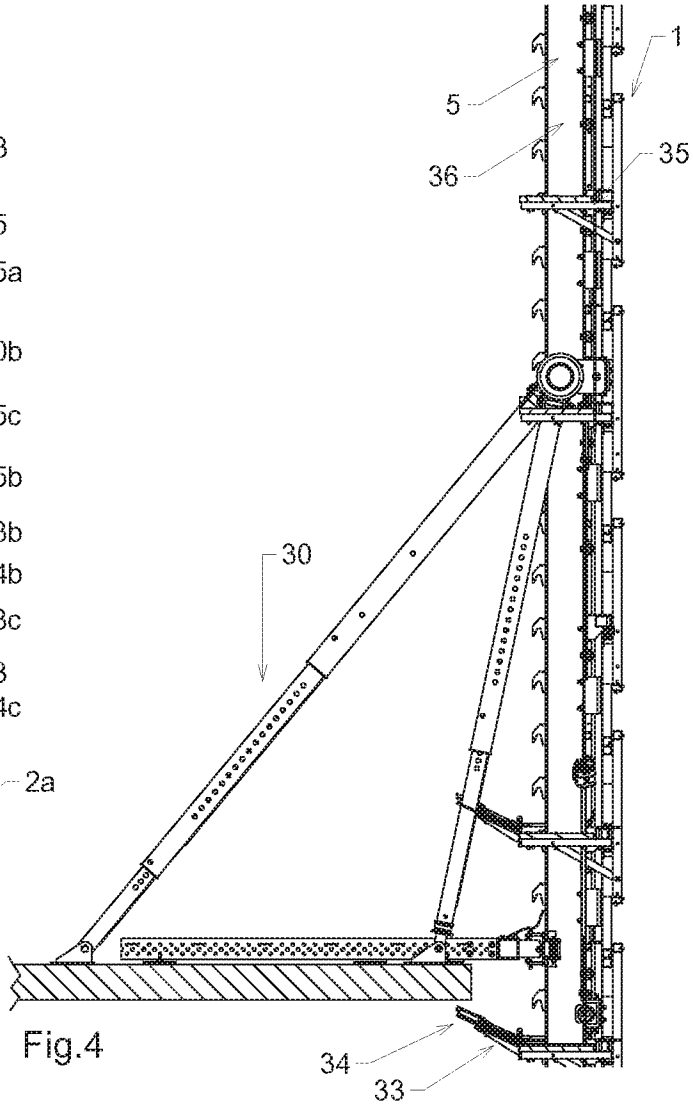
FIG. 4 is a detailed side view of the safety screen of FIGS. 1 to 3 in the first operating position.

In the shown example, a skirt member 33 extends horizontally over a portion, in particular over the larger part of the lateral extension of the safety screen 1. The skirt member 31 projects inwards from one of the screen members 4 (see, in particular, FIG. 4, FIG. 10 and FIG. 11). The skirt member 33 has a middle skirt part 33*a* and, on either side of the middle skirt part 33*a*, a first lateral skirt extension 33*b* and a second lateral skirt extension 33*c*. The second lateral skirt extension 33*c* can be extended laterally from a position on top of the first lateral skirt extension 33*b* to a position extending the first lateral skirt extension 33*b* (see FIG. 10) when the lateral screen member 12 is brought into its extended state. The skirt member 33 is maintained in its horizontally extending position independently of the sideward tilt of the safety screen 1.

In the shown example, a flap member 34 is connected to a free end of the skirt member 33, the flap member 34 being pivotally connected to the skirt member 33 so that the flap member 34 can be pivoted upwards from the state shown in FIG. 10 extending the skirt member 33. The flap member 34 has a middle flap part 34*a* connected to the middle skirt part 33*a*, a first lateral flap part 34*b* connected to the first lateral skirt extension 33*b* and a second lateral flap part 34*c* connected to the second lateral skirt extension 33*c* on either side of the middle flap part 34*a*.

Figure 33:
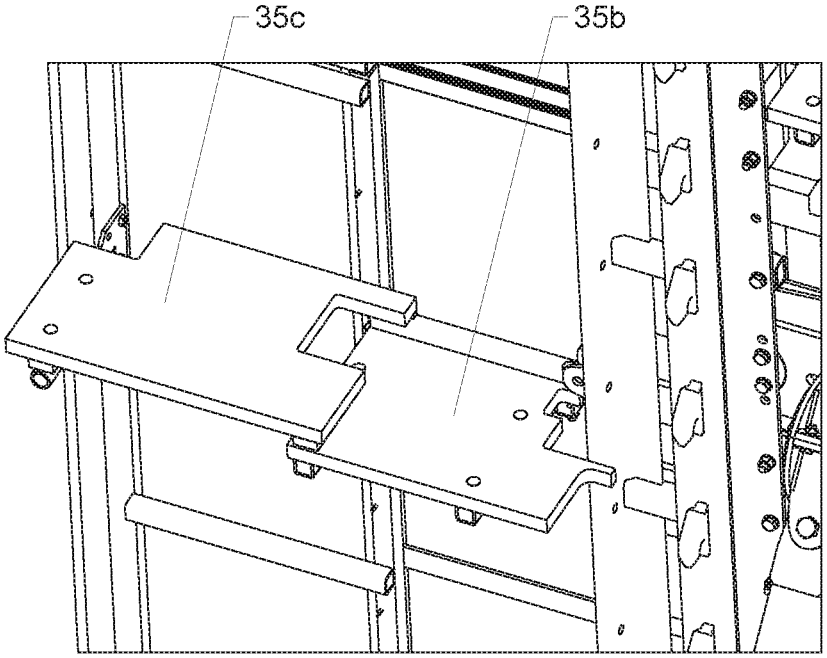
FIG. 33 and FIG. 34 are detailed views of the back side of the safety screen showing lateral platform parts in a fully extended state.

In the shown example, a platform 35 for workers projects inwards from one of the screen members 4 (see FIG. 10). The platform 35 has a middle platform part 35*a* and, on either side of the middle platform part 35*a*, a first lateral platform part 35*b* and a second lateral platform part 35*c* (see FIG. 33 to FIG. 38 for greater detail). The second lateral platform part 35*c* is extended laterally from a retracted position on top of the first lateral platform part 35*b* (see FIG. 37 and FIG. 38) via a partially extended position (see FIG. 35 and FIG. 36) to an extended position (see FIG. 33 and FIG. 34) extending the first lateral platform part 35*b* when the lateral screen member 12 is brought into its extended state. The platform 35 is maintained in its horizontally extending position independently of the sideward tilt of the safety screen 1.

Figure 34:
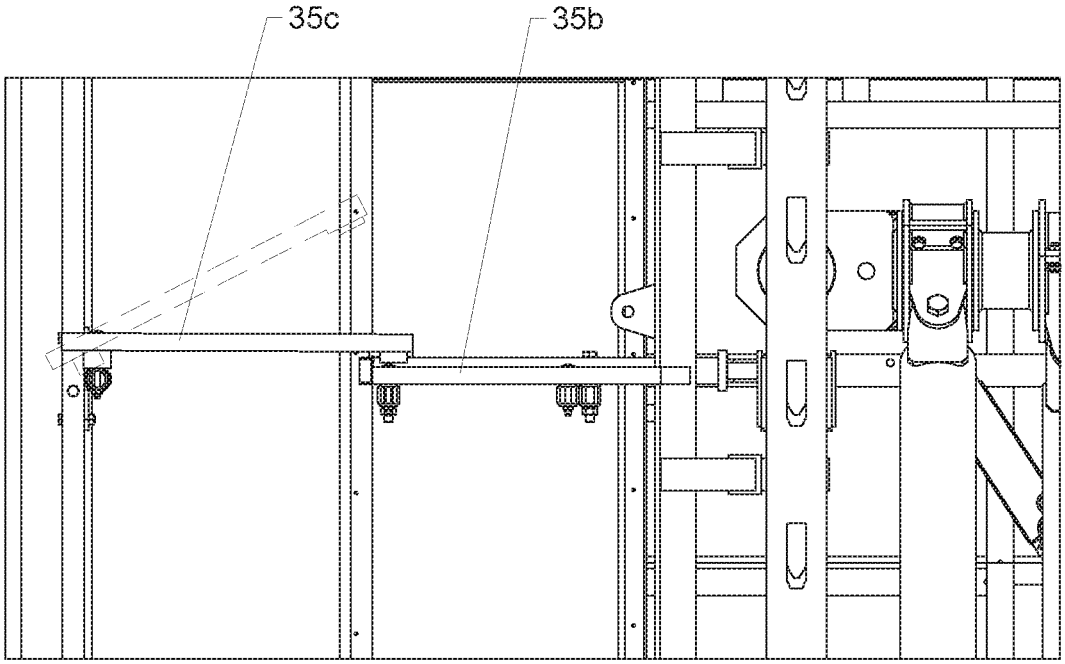
Figure 35:
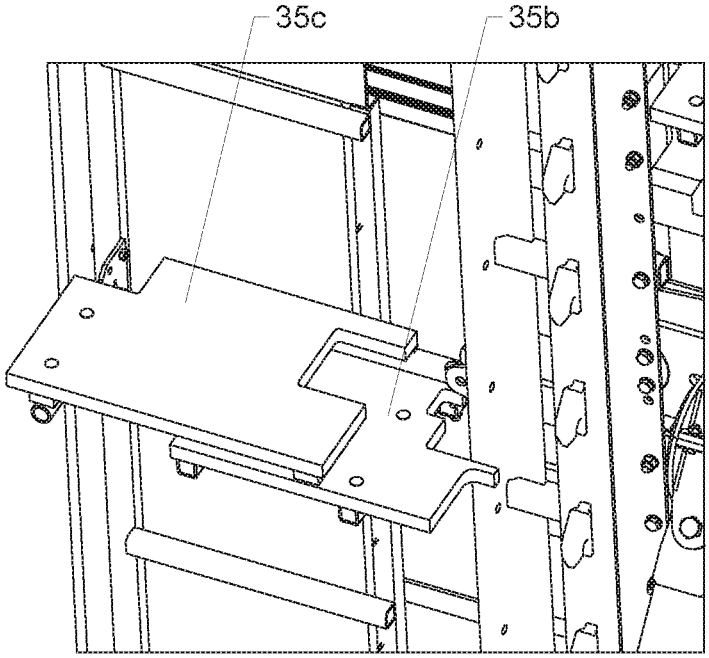
FIG. 35 and FIG. 36 are detailed views of the back side of the safety screen showing lateral platform parts in a partially retracted state.
Figure 36:
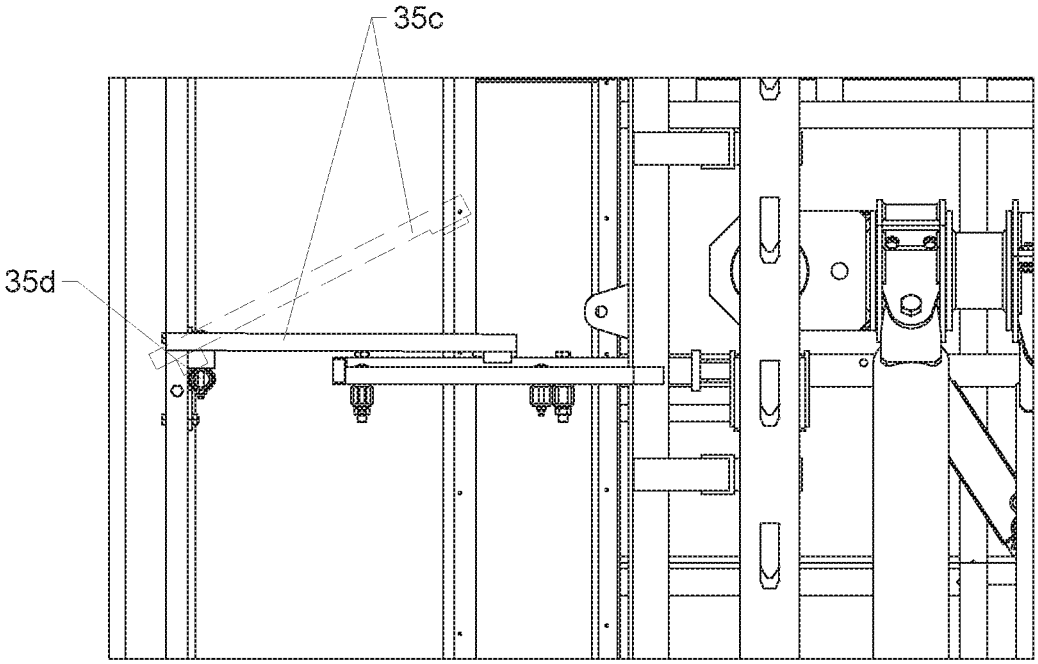
Figure 37:
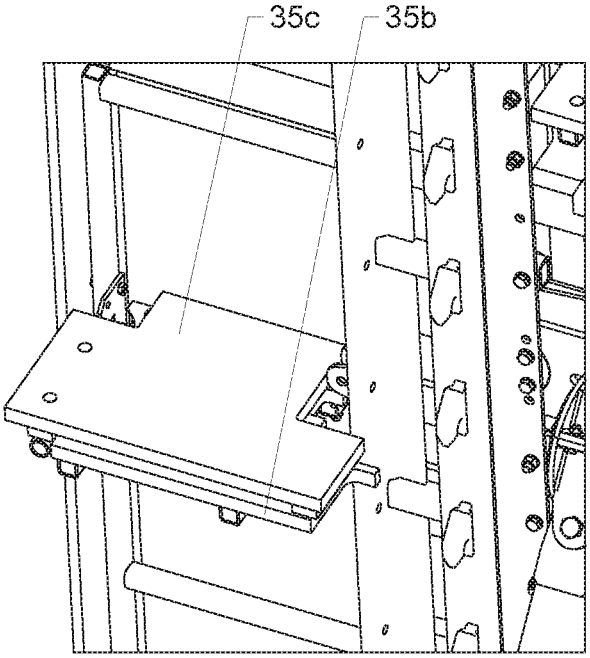
FIG. 37 and FIG. 38 are detailed views of the back side of the safety screen showing lateral platform parts in a fully retracted state.
Figure 38:
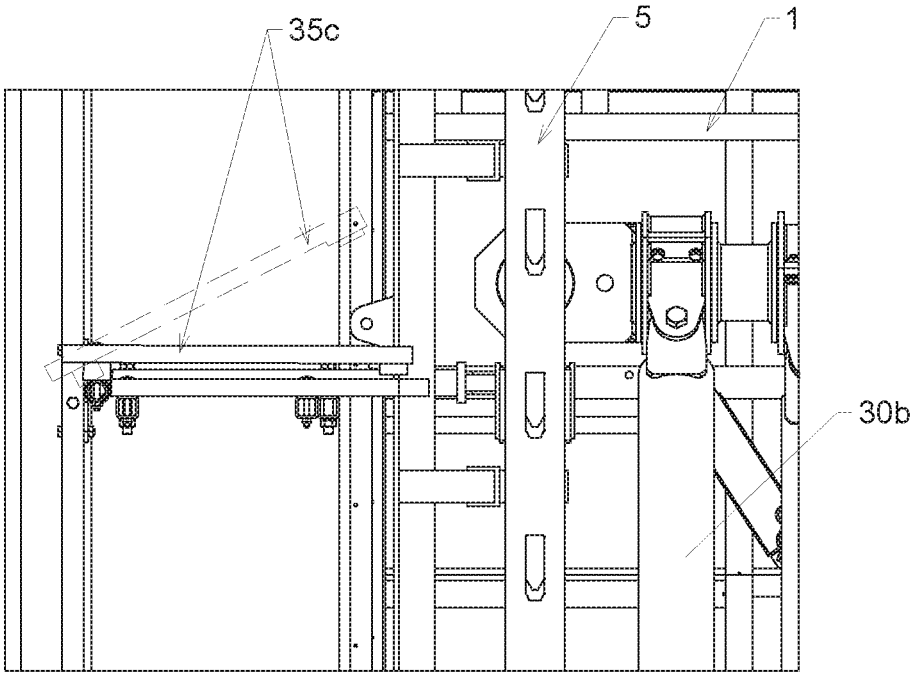
Figure 41:
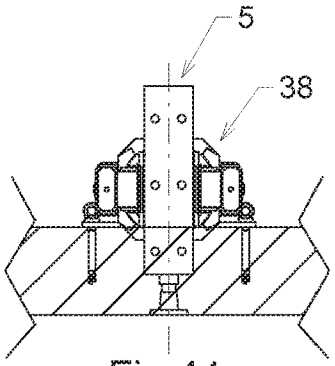
FIG. 39, FIG. 40 and FIG. 41 are detailed views of a climbing shoe attached to an end of a support arm, the climbing shoe supporting a climbing rail which is an integral part of the longitudinal carrier in a vertical position.
Figure 39:
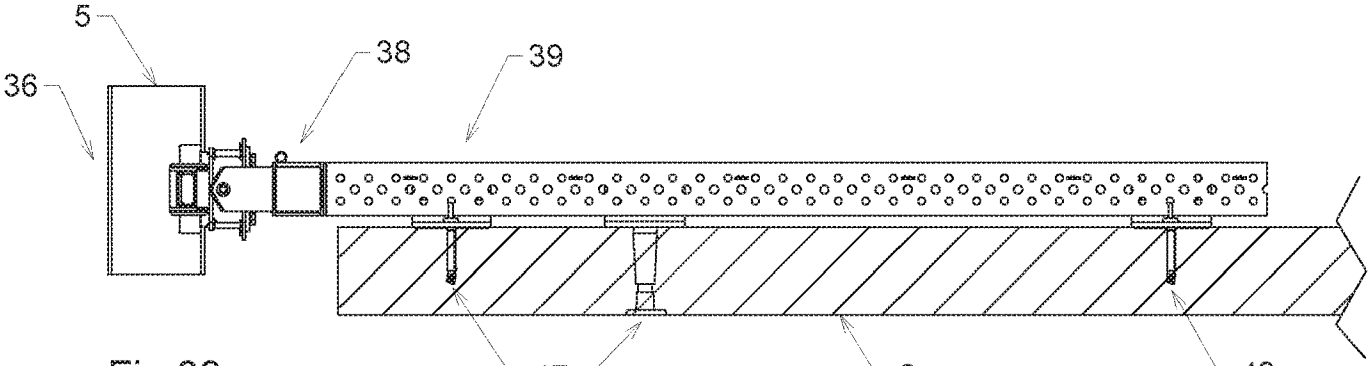
Figure 40:
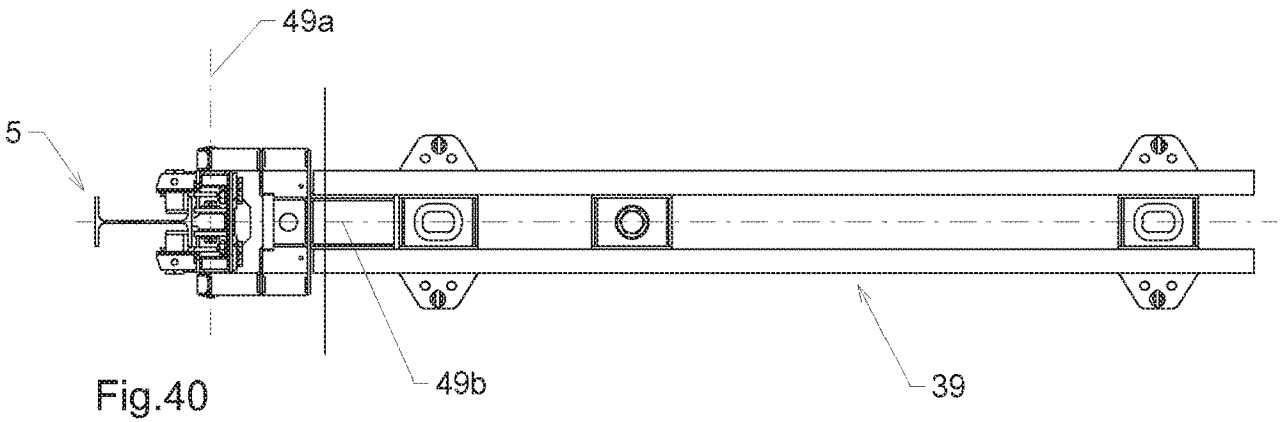
Figure 42:
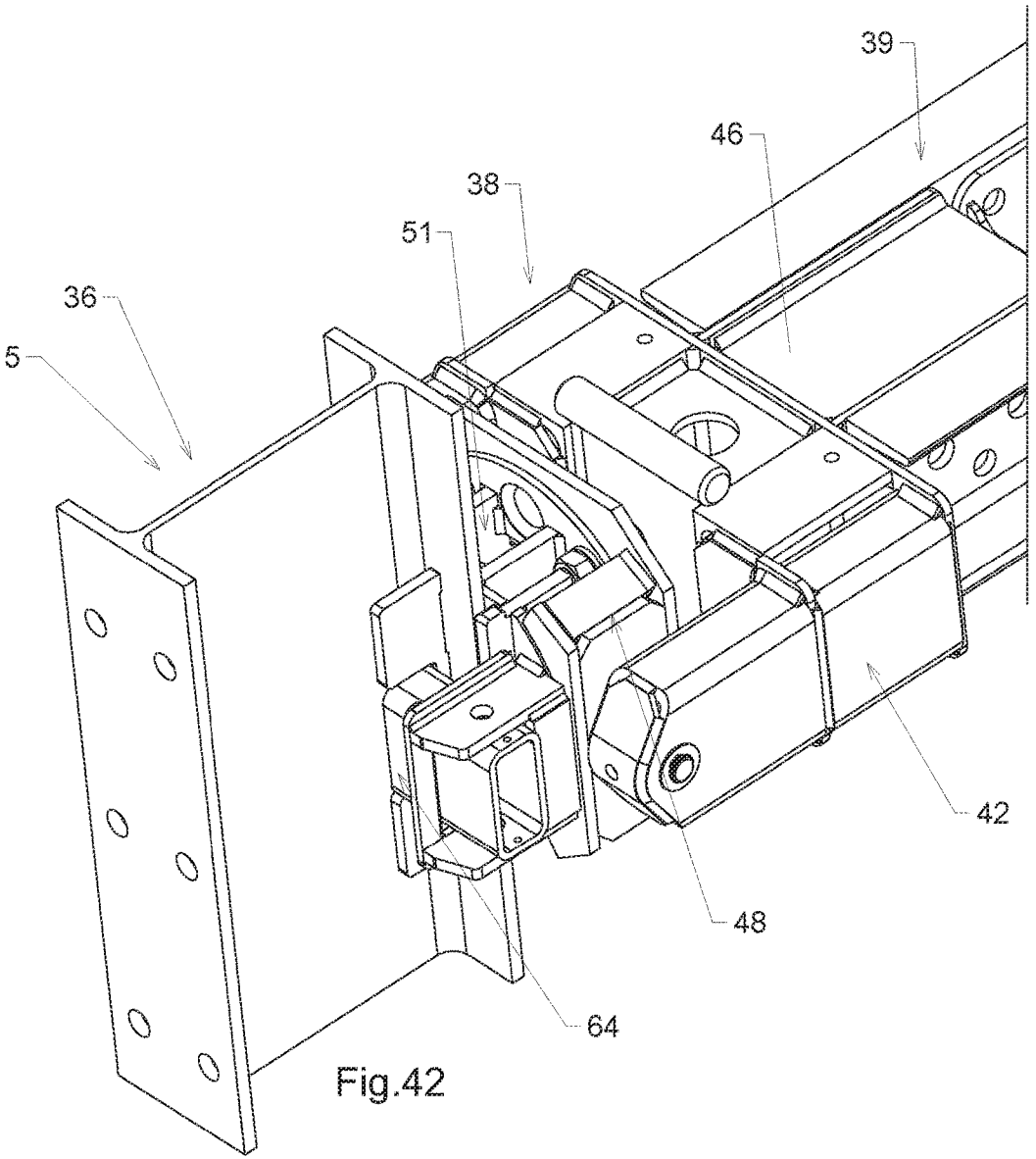
FIG. 42 is a detailed view of the climbing shoe of FIG. 39 to FIG. 41 in a position supporting the climbing rail.
Figure 44:
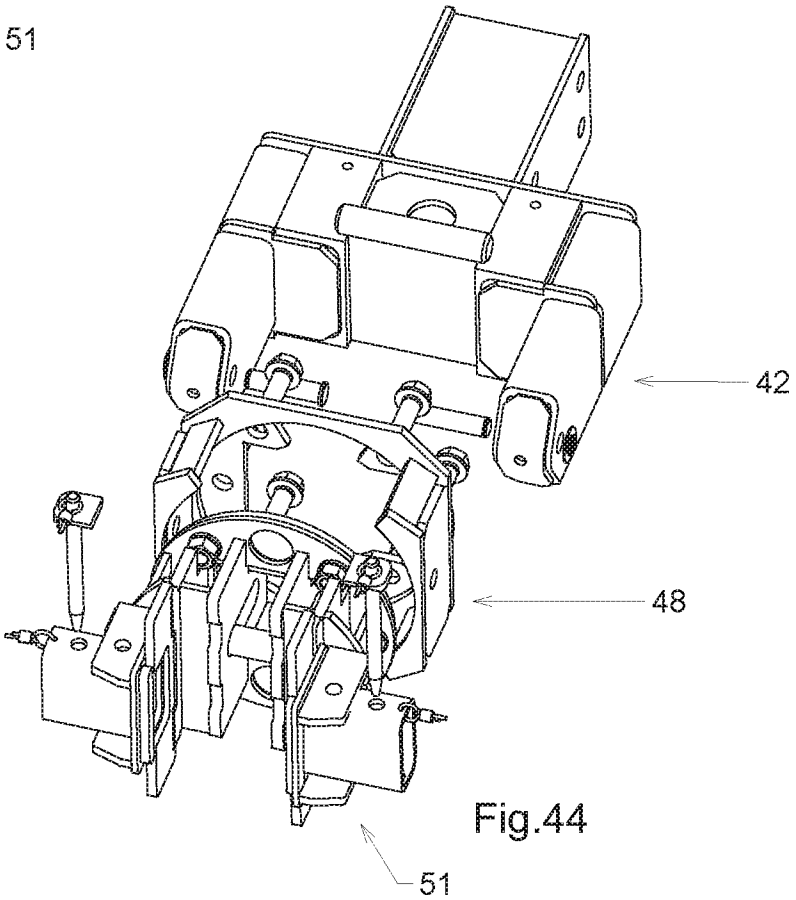
FIG. 43, FIG. 44, FIG. 45 and FIG. 46 are exploded views of the climbing shoe of FIG. 39 to 42.
Figure 43:
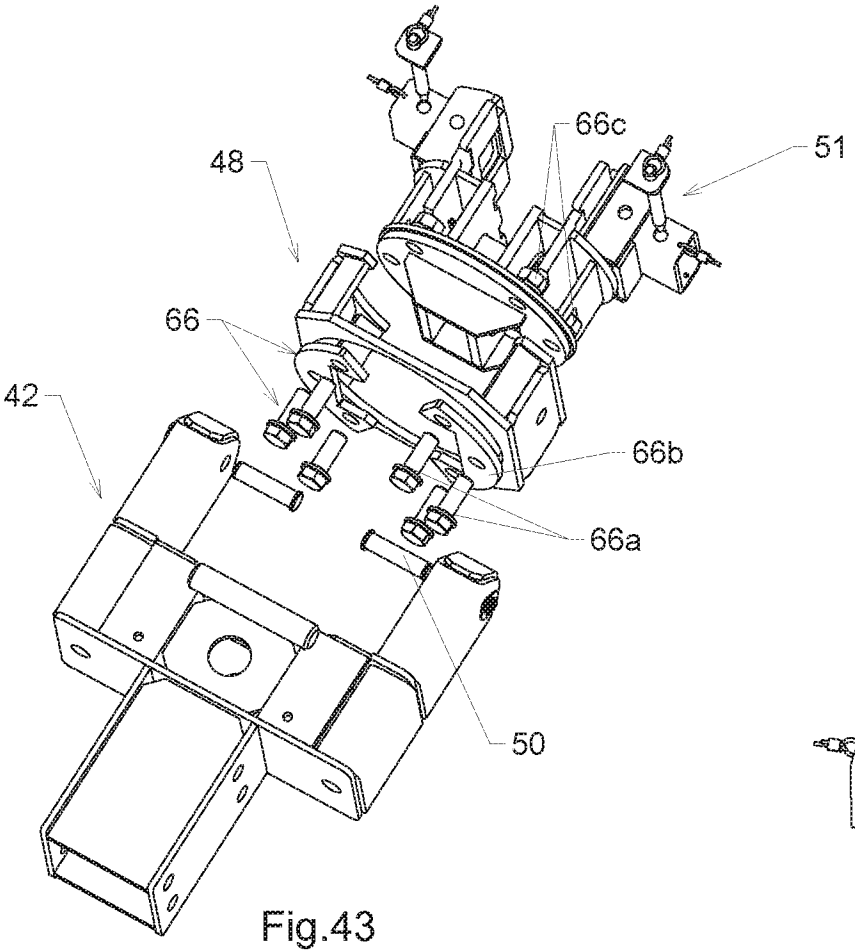
Figure 45:
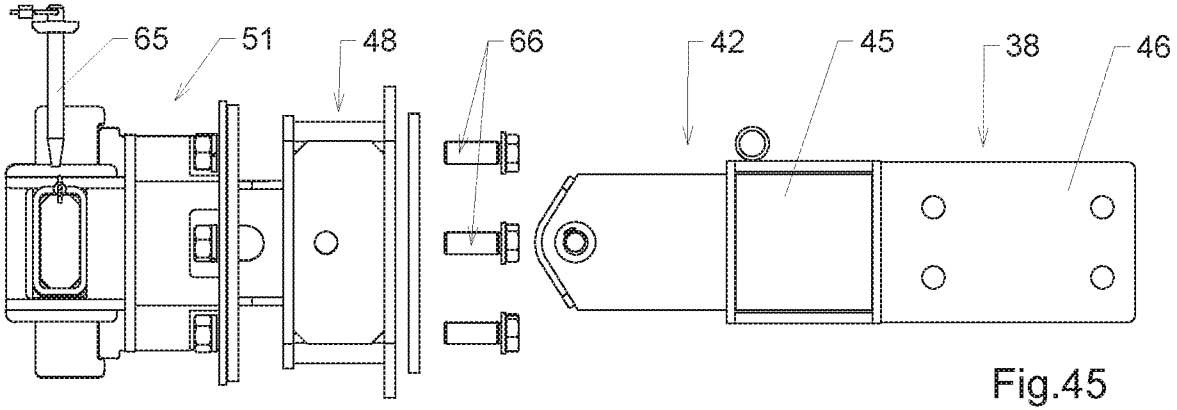
Figure 46:
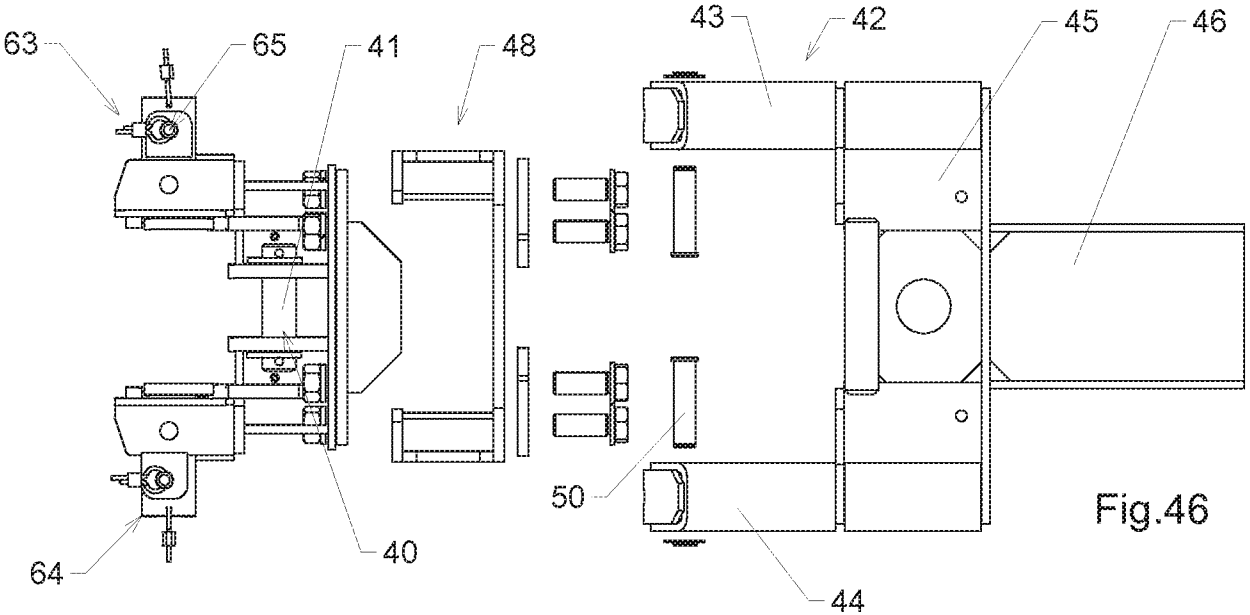
Figure 49:
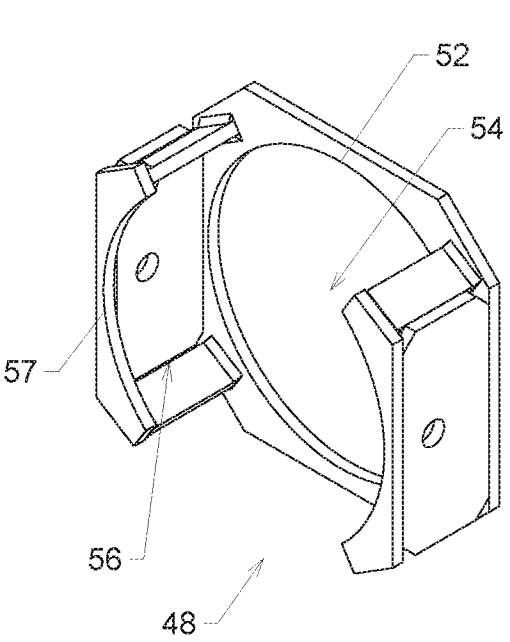
FIG. 49 is a perspective view of an outer member of the climbing shoe of FIG. 39 to 48.
Figure 48:
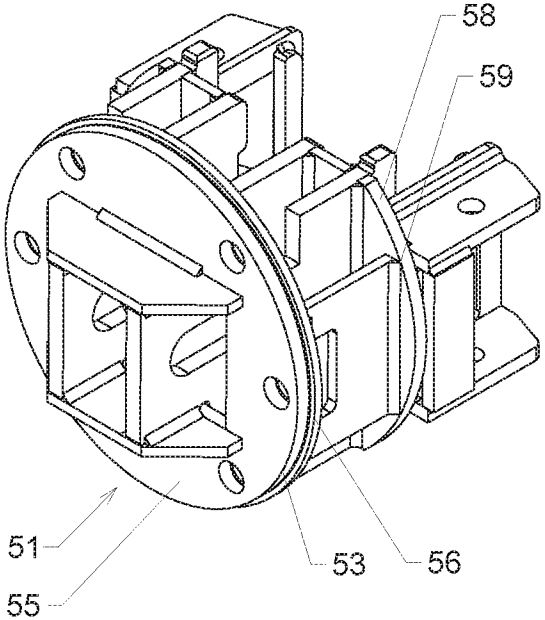
FIG. 47 and FIG. 48 are perspective views of an inner member of the climbing shoe of FIG. 39 to 46.
Figure 47:
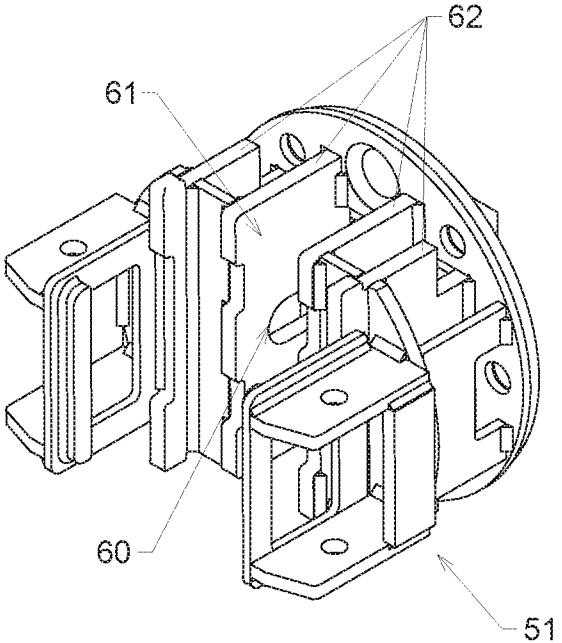
Figure 53:
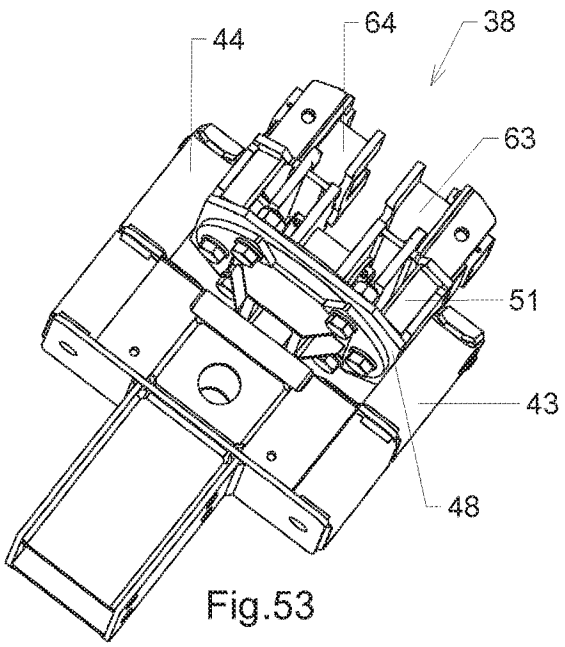
FIG. 50, FIG. 51, FIG. 52, FIG. 53 and FIG. 54 are views of the climbing shoe of FIG. 39 to 49 with locking and guiding members arranged in an inner position for locking and guiding the climbing rail (not shown here).
Figure 52:
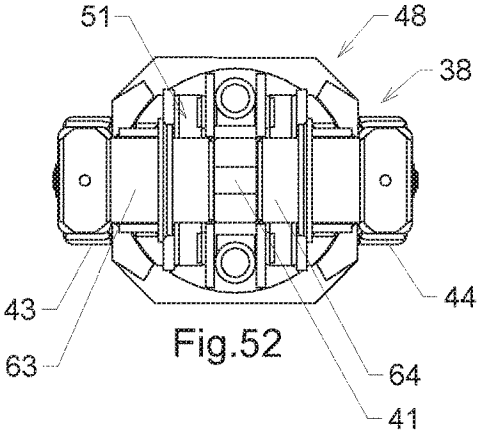
Figure 54:
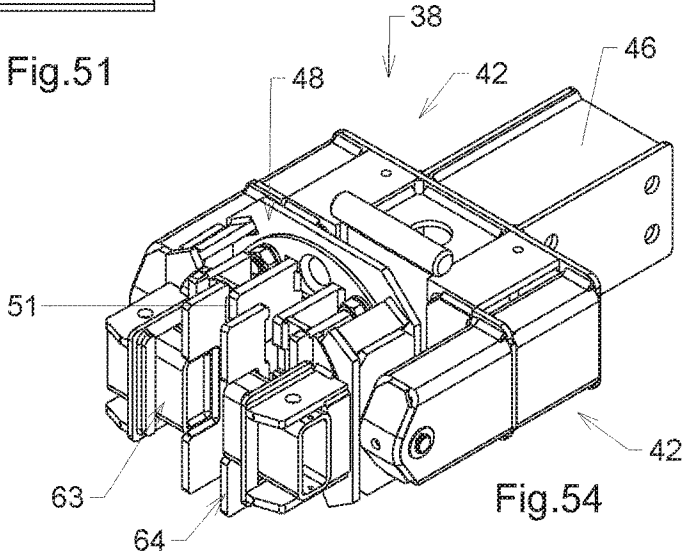
Figure 50:
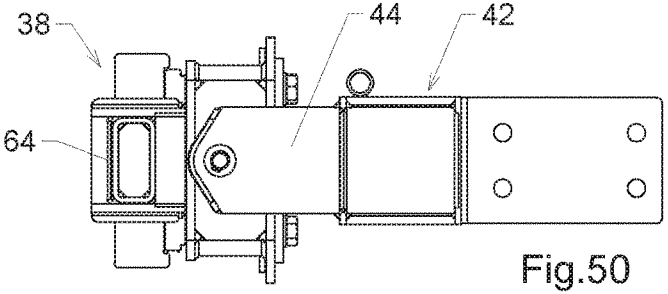
Figure 51:
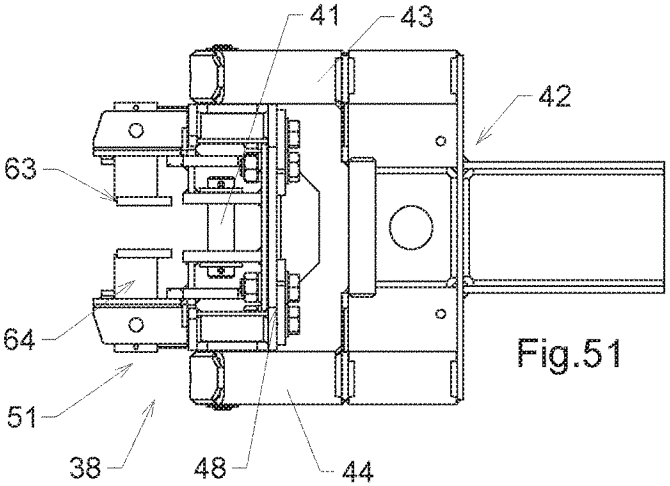
Figure 55:
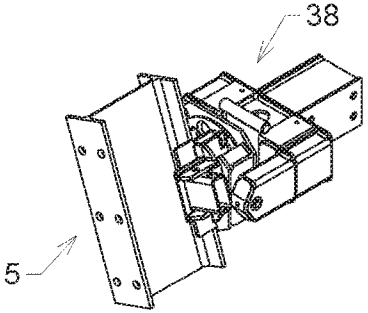
FIG. 55 and FIG. 56 are views of the climbing shoe of FIG. 39 to FIG. 54 with the inner member tilted sideward in a first direction.
Figure 56:
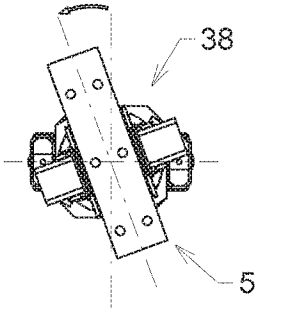
Figure 58:
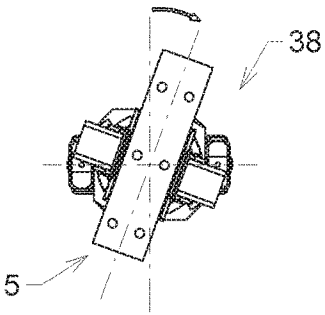
FIG. 57 and FIG. 58 are views of the climbing shoe of FIG. 39 to FIG. 56 with the inner member tilted sideward in a second, opposite direction.
Figure 57:
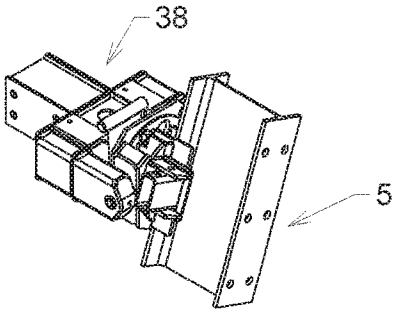
Figure 59:
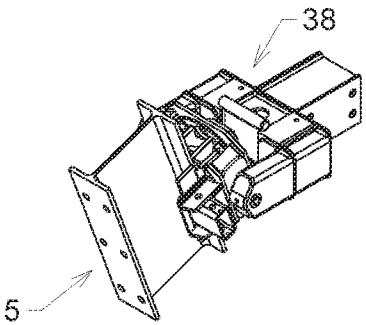
FIG. 59 and FIG. 60 are views of the climbing shoe of FIG. 39 to FIG. 58 with the inner member tilted backward.
Figure 60:
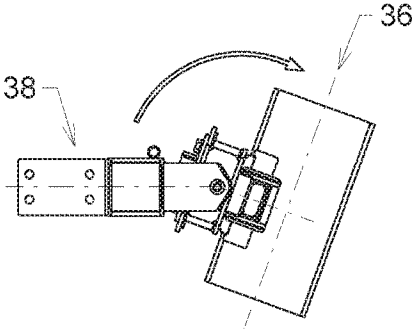
Figure 62:
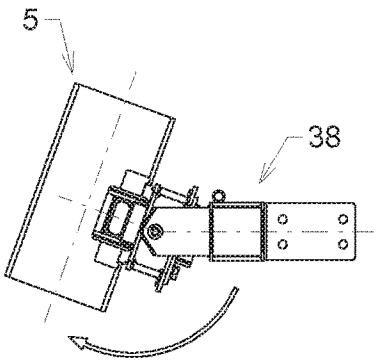
FIG. 61 and FIG. 62 are views of the climbing shoe of FIG. 39 to FIG. 60 with the inner member tilted forward.
Figure 61:
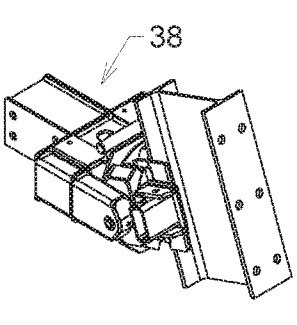
Figure 65:
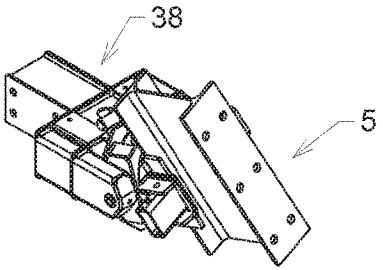
FIG. 65 and FIG. 66 are views of the climbing shoe of FIG. 39 to FIG. 62 with the inner member tilted forward and sideward in a second, opposite direction.
Figure 66:
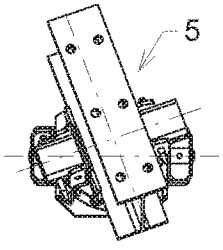
Figure 64:
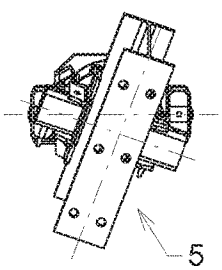
FIG. 63 and FIG. 64 are views of the climbing shoe of FIG. 39 to FIG. 62 with the inner member tilted backward and sideward in a first direction.
Figure 63:
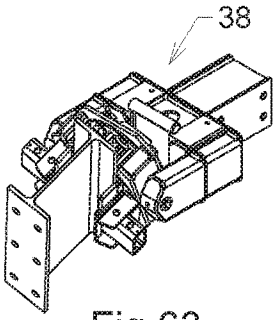

In the shown example, the second lateral platform part 35*c* may be pivoted about a pivot axis 35*d* extending perpendicularly to the main plane of the screen member 4 into an inclined position shown with dashed lines in FIG. 34, FIG. 36 and FIG. 38 to remain in a horizontal position (parallel to the middle platform part 35*a*) when the longitudinal carriers 5 and thus the lateral screen members 12 are tilted sideward.

In the shown example, the longitudinal carriers 5 are climbing rails 36 having a double-T-profile with vertically spaced engaging members 37, in particular hooks, for engaging climbing shoes 38 fixed on the floor 2 adjacent to the floor edge 2*a*. The climbing shoes 38 are mounted on longitudinal support arms 39 that preferably extend perpendicularly to the floor edge 2*a*.

In the shown example, the safety screen 1 is supported on a single floor 2 by means of a pair of climbing shoes 38 (i.e. floor supports and guides) and the first pair 31 and second pair 32 of anchoring bars 30.

In the shown example, the climbing shoes 38 are adapted for allowing a backward, forward and sideward tilting of the safety screen 1 so that the safety screen 1 can be arranged in all of the first, second, third, fourth, fifth and sixth operating positions.

In the shown example, the climbing shoe 38 comprises a support member 40 for releasably engaging the climbing rail 36. In the shown example, the support member 40 has a pin 41 for supporting one of the hooks 37 thereon. The climbing shoe 38 further comprises a fork member 42 with a first flange 43 and a second flange 44 spaced from one another in transverse direction. The first flange 43 and the second flange 44 project longitudinally from a transverse connecting arm 45, which has a central mount 46 for connection with the support arm 39. The support arm 39 preferably extends longitudinally in direction perpendicular to the floor edge 2*a*. In the shown example, more than one, for example three, connections 47 spaced longitudinally attach the support arm 39 to the floor 2.

In the shown example, the climbing shoe 38 comprises an outer member 48 pivotally connected to first flange 43 and second flange 44 about a transverse axis 49*a* extending parallel to the floor edge 2*a*. In the shown example, transverse axis 49*a* is defined by two pivot pins 50 extending perpendicularly to the first flange 43 and second flange 44, respectively. The transverse axis 49*a* allows the safety screen 1 to be pivoted backwards and forwards. The climbing shoe 38 further comprises an inner member 51 pivotally connected to the outer member 48 about a longitudinal axis 49*b* (extending perpendicularly to the screening surface 1*a* in the first operating position) so that the inner member 51 is tiltable sideward in both directions relative to the outer member 48.

In the shown example, the outer member 48 can be pivoted about the transverse axis 49*a* by at least 30 degrees backwards and forwards with respect to a central position of the outer member 48 corresponding to the first operating position. The inner member 51 can be pivoted about the longitudinal axis 49*b* by at least 30 degrees in both directions with respect to a central position of the inner member 48 (corresponding to the first operating position) independently of the backward or forward tilt of the outer member 48.

In the shown example, the outer member 48 has a first (inner) sliding support surface 52 and the inner member 51 has a corresponding first (outer) sliding surface 53. The first sliding surface 53 of the inner member 52 glides on the first sliding support surface 52 of the outer member 48 when adjusting the sideward tilt of the safety screen 1. Thus, the inner member 51 pivots about a virtual longitudinal axis defined by the concentric arrangement of the first sliding support surface 52 of the outer member 48 and the first sliding surface 53 of the inner member 51.

In the shown example, the first sliding support surface 52 of the outer member 48 and the first sliding surface 53 of the inner member 51 are circular in cross-section (perpendicular to the longitudinal axis 49*b* in the first operating position). The outer member 48 has a first circular through opening 54, the circumference of which defining the first sliding support surface 52. Preferably, a ratio between a diameter of the first circular opening 54 and an extension of the first sliding support surface 52 in direction of the longitudinal axis 49*b* is more than 3:1, in particular more than 5:1. The inner member 51 has a first circular disk 55 with a shape accurately fitting into the first circular opening 54 of the outer member 48. However, the first circular disk 55 may have an extension in direction of the longitudinal axis 49*b* that is slightly larger than that of the circular opening 54 to ensure rotatability of the inner member 51 against the outer member 48. Furthermore, the inner member 51 has an offset rim 56 adjacent the first disk 55, the offset rim 56 extending outwardly in radial direction from the adjacent first sliding surface 53 of the inner member 51.

In the shown example, the outer member 48 has a second circular opening 56 which is spaced from the first circular opening 54 in direction of the longitudinal axis 49*b*. The second circular opening 56 delimits a second sliding support surface 57 for a sliding support of a second sliding surface 58 of the inner member 51. The inner member 51 has a second disk 59 accurately fitting into the second circular opening 56 of the outer member 48. The second disk 59 has a vertically extending aperture 60 for allowing the introduction of the engagement member 37 of the climbing rail 36 into a space 61 between the first disk 55 and the second disk 59. The first disk 55 and the second disk 59 are connected by a plurality of webs 62.

In the shown example, the support member 40 is moveably mounted on the inner member 51 by means of a guide. In this way, the support member 40 can be transferred from a support position for supporting the engagement member 37 of the climbing rail 36 and a retracted position for allowing the climbing rail 36 to be moved upwards. In particular, the engagement members 37 may temporarily push the support member 40 to the retracted position when the climbing rail 36 is moved upwards. The support member 40 may have a spring (not shown) for biasing the pin 41 in direction of the support position so that the engagement member 36 is automatically supported on the pin 41 after completion of the upwards movement of the climbing rail 36.

In the shown example, the pin 41 is colinear with the transverse axis 49*a* and symmetrically arranged about a vertical plane extending centrally between the first flange 43 and the second flange 44 of the fork member 42.

In the shown example, a first locking and guiding member 63 and a second locking and guiding member 64 are connected to the inner member 51. The first locking and guiding member 63 and the second locking and guiding member 64 are moveable in direction of the transverse axis 49*a* between an outer position for inserting the climbing rail 36 into the climbing shoe 38 and an inner position for locking the climbing rail 36 to the climbing shoe 38 and for guiding the climbing rail 36 inside the climbing shoe 38. Safety pins 65 are provided for locking the first locking and guiding member 63 and the second locking and guiding member 64 in the support position and/or in the retracted position.

In the shown example, attachment members 66 are provided to axially secure the inner member 51 to the outer member 48. The attachment members 66 may comprise screws 66*a*, washers 66*b* and nuts 66*c*.

In the shown example, movement of the climbing rail 36 in direction of the transverse axis 49*a* is restricted by first guiding surfaces of the inner member 51 of the climbing shoe 38. In the same fashion, movement of the climbing rail 36 in direction of the longitudinal axis 49*b* is restricted by second guiding surfaces of the first locking and guiding member 63, second locking and guiding member 64 and inner member 51 of climbing shoe 38. For allowing the upward translation of the climbing rail 36, the climbing rail 36 is connected to the climbing shoe 38 with a first clearance in direction of the transverse axis 49*a* and a second clearance in direction of the longitudinal axis 49*b*. Preferably, a first ratio between a height (vertical extension) of the first guiding surfaces at the inner member 51 and the first clearance is at least 50:1, more preferably at least 100:1. Likewise, it is preferred that a second ratio between a height (vertical extension) of the second guiding surfaces at the first locking and guiding member 63, second locking and guiding member 64 and inner member 51 and the second clearance is at least 50:1, more preferably at least 100:1. For example, the height of the first and/or second guiding surfaces at the first locking and guiding member 63, second locking and guiding member 64 and inner member 51 may be at least 150 mm, preferably more than 180 mm, e.g. 200 mm. This construction ensures that the climbing rail 36, for example a front flange of a twin flanged climbing rail, is securely translated upwards inside the climbing shoe 38 without risk of jamming independently of the sideward and backward/forward tilt of the inner member 51 of climbing shoe 38.

The invention claimed is:

1. A safety screen comprising:

a plurality of screen members vertically arranged above one another; and two longitudinal carriers pivotally connected to the plurality of screen members, wherein, in a first operating position, the two longitudinal carriers extend vertically and the plurality of screen members extends horizontally, and wherein, in a second operating position, the two longitudinal carriers are inclined at an angle to vertical and the plurality of screen members extends horizontally, offset from one another horizontally, wherein the plurality of screen members, in the first operating position, have a first vertical overlap and the plurality of screen members, in the second operating position, have a second vertical overlap, wherein viewed from a horizontal direction an amount of a respective screen member forming the second vertical overlap is larger than the first vertical overlap, and wherein the two longitudinal carriers are pivotable about pivot axes extending perpendicular to main planes of the screen members defining a screening surface of the safety screen.

2. The safety screen according to claim 1, wherein the safety screen, in the second operating position, forms a rhomboid with a horizontally extending upper edge, a horizontally extending lower edge, and opposite side edges inclined at an angle to vertical.

3. The safety screen according to claim 1, wherein each of the plurality of screen members has a first screen panel and a second screen panel, the second screen panel being offset from the first screen panel in a direction perpendicular to a main plane of the first screen panel.

4. The safety screen according to claim 3, wherein at least one additional screen member is arranged at the sides of the plurality of screen members, the at least one additional screen member being pivotally connected to the plurality of screen members, and wherein, in the second operating position, the at least one additional screen member is inclined at an angle to vertical.

5. The safety screen according to claim 4, wherein first pivot axes of the plurality of screen members and second pivot axes of the at least one additional screen member lie in identical parallel horizontal planes in both the first operating position and the second operating position of the safety screen.

6. The safety screen according to claim 4, wherein the at least one additional screen member has an inner panel and an outer panel, the outer panel being moveable laterally between a retracted state and an extended state.

7. The safety screen according to claim 1, wherein a first pivot connection between one of the plurality of screen members and one of the two longitudinal carriers comprises a first disk element and a housing with a plate having an opening, the first disk element being arranged in the opening of the housing.

8. The safety screen according to claim 7, wherein the first pivot connection further comprises a second disk element larger in diameter than the first disk element, the first and second disk elements being arranged on either side of the opening of the housing.

9. The safety screen according to claim 1, further comprising:

a first horizontal bracing and a second horizontal bracing, the first and second horizontal bracings being spaced in vertical direction from one another, the first and second horizontal bracings being pivotally connected to the two longitudinal carriers.

10. The safety screen according to claim 9, wherein a first diagonal adjustment member for adjusting a sideward inclination of the two longitudinal carriers is connected to the first and second horizontal bracings.

11. The safety screen according to claim 10, wherein the first diagonal adjustment member comprises a first telescopic bar.

12. The safety screen according to claim 1, wherein, in a third operating position, the two longitudinal carriers are inclined backwards from vertical and, in a fourth operating position, the two longitudinal carriers are inclined forward from vertical.

13. The safety screen according to claim 1, wherein at least two anchoring bars fixable on a floor maintain the safety screen in the first or second operating position.

14. The safety screen according to claim 1, wherein a skirt member projects inwards from one of the plurality of screen members, and wherein a flap member is connected to a free end of the skirt member, the flap member being flappable upwards with respect to the skirt member.

15. The safety screen according to claim 1, wherein the two longitudinal carriers are climbing rails with engaging members for engaging climbing shoes fixable adjacent an edge of a floor.

16. A safety screen comprising:

a plurality of screen members vertically arranged above one another; and two longitudinal carriers pivotally connected to the plurality of screen members, wherein, in a first operating position, the two longitudinal carriers extend vertically and the plurality of screen members extends horizontally, and wherein, in a second operating position, the two longitudinal carriers are inclined at an angle from vertical and the plurality of screen members extends horizontally, offset from one another horizontally, wherein the plurality of screen members, in the first operating position, have a first vertical overlap and the plurality of screen members, in the second operating position, have a second vertical overlap, wherein viewed from a horizontal direction the second vertical overlap is larger than the first vertical overlap; and wherein in the second operating position, upper and lower edges of the screen members extend horizontally while side edges of the screen members extend vertically.

17. A safety screen comprising:

a plurality of screen members vertically arranged above one another; and two longitudinal carriers pivotally connected to the plurality of screen members, wherein, in a first operating position, the two longitudinal carriers extend vertically and the plurality of screen members extends horizontally, and wherein, in a second operating position, the two longitudinal carriers are inclined at an angle from vertical and the plurality of screen members extends horizontally, offset from one another horizontally, wherein the plurality of screen members, in the first operating position, have a first vertical overlap and the plurality of screen members, in the second operating position, have a second vertical overlap, wherein viewed from a horizontal direction the second vertical overlap is larger than the first vertical overlap; and wherein the screen members have rectangular screens, wherein main planes of the screen are vertical in the first operating position.

* * * * *